US010124581B2

(12) United States Patent
Tamura et al.

(10) Patent No.: US 10,124,581 B2
(45) Date of Patent: Nov. 13, 2018

(54) LIQUID DISCHARGE APPARATUS AND HEAD UNIT

(71) Applicant: SEIKO EPSON CORPORATION, Tokyo (JP)

(72) Inventors: Noboru Tamura, Nagano (JP); Toru Matsuyama, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/456,946

(22) Filed: Mar. 13, 2017

(65) Prior Publication Data

US 2017/0266961 A1 Sep. 21, 2017

(30) Foreign Application Priority Data

Mar. 17, 2016 (JP) ..... 2016-054437

(51) Int. Cl.
*B41J 2/045* (2006.01)

(52) U.S. Cl.
CPC ..... *B41J 2/04541* (2013.01)

(58) Field of Classification Search
CPC ..... B41J 2/04508; B41J 2/04541; B41J 2/04581; B41J 2/14201; B41J 2/15; B41J 25/005; B41J 25/001; B41J 19/00
See application file for complete search history.

(56) References Cited

U.S. PATENT DOCUMENTS

| | | | | |
|---|---|---|---|---|
| 6,334,668 | B1 | 1/2002 | Isamoto | |
| 6,520,611 | B2 * | 2/2003 | Ishinaga | B41J 2/04518 347/19 |
| 8,833,890 | B2 | 9/2014 | Endo et al. | |
| 9,108,404 | B2 | 8/2015 | Okuyama | |
| 2005/0179750 | A1 * | 8/2005 | Hayasaki | B41J 2/17546 347/86 |

FOREIGN PATENT DOCUMENTS

| | | | |
|---|---|---|---|
| JP | 2000-343690 | A | 12/2000 |
| JP | 2014-076567 | A | 5/2014 |
| JP | 2014-184589 | A | 10/2014 |

* cited by examiner

*Primary Examiner* — Julian D Huffman

(57) ABSTRACT

A liquid discharge apparatus has a head provided with discharge sections which discharge a liquid, a drive circuit configured to generate driving signals for driving the discharge sections and discharging the liquid, a carriage mounted with the head and the drive circuit, and a carriage support section configured and arranged to support the carriage. A shortest distance between the carriage support section and the drive circuit is shorter than a shortest distance between the carriage support section and the discharge section which is closest to the carriage support section.

5 Claims, 26 Drawing Sheets

<DECODING CONTENT FOR DECODERS>

| PRINTING DATA | T1 | | T2 | |
|---|---|---|---|---|
| | Sa | Sb | Sa | Sb |
| (1, 1) | H | L | H | L |
| (0, 1) | H | L | L | H |
| (1, 0) | L | L | L | H |
| (0, 0) | L | H | L | L |

MSB LSB

LIQUID DISCHARGE APPARATUS AND HEAD UNIT

CROSS-REFERENCE TO RELATED APPLICATIONS

This application claims priority to Japanese Patent Application No. 2016-054437 filed on Mar. 17, 2016. The entire disclosure of Japanese Patent Application No. 2016-054437 is hereby incorporated herein by reference.

BACKGROUND

Technical Field

The present invention relates to a liquid discharge apparatus and a head unit.

Related Art

It is known that piezoelectric elements (for example, a piezo element) are used in discharge liquid apparatuses such as ink jet printers which print images and text by discharging ink. The piezoelectric elements are provided to correspond to a plurality of nozzles in a recording head (an ink jet head) and dots are formed by specific amounts of ink (liquid) being discharged at specific timings from the nozzles due to each of the piezoelectric elements being driven in accordance with driving signals. In consideration of electricity, since the piezoelectric elements have a capacitive load such as a capacitor, it is necessary for a sufficient current to be supplied for the piezoelectric elements for each of the nozzles to be operated. For this reason, there is a configuration in the liquid discharge apparatus described above where the piezoelectric elements are driven by a drive circuit supplying driving signals, which are amplified using an amplification circuit, to the head.

For example, in the liquid discharge apparatus such as a serial printer where printing is performed by a carriage which is mounted with the head scanning back and forth, driving signals with high voltages, which are amplified using an amplification circuit which is provided on the main body side of the printer, are typically supplied to the head which is mounted on the carriage via a cable. In this liquid discharge apparatus, it is necessary for the length of the cable to be double or more of the scanning width of the carriage, and there are problems in that the waveforms of the driving signals which are transferred by the cable become distorted and printing quality deteriorates due to the effects of static electricity which is generated due to the cable rubbing against the members inside a casing and various types of external noise such as electrostatic noise which is easily picked up due to the antenna effect with the cable being in the shape of a loop. In particular, as the cable typically becomes longer in large format printers which are able to print onto large sheets of paper such as A2 size or larger, it is easier for the waveforms of the driving signals which are transferred by the cable to become distorted and it is easy for printing quality to deteriorate. With regard to these problems, a liquid discharge apparatus is proposed to reduce the distorting of the driving waveforms due to the effects of noise by also mounting the drive circuit on the carriage along with the head and shortening the transfer path for the driving signals.

For example, Japanese Patent Application Publication No. 2000-343690 discloses a technique for reducing the distorting of the driving waveforms by a drive circuit which uses a class AB amplifier as the amplification circuit being mounted on the carriage. However, power consumption and the amount of heat generation are high due to the large currents flowing through the class AB amplifier, and the size and mounting weight of the carriage is increased due to it being necessary to mount a heat sink for releasing heat on the carriage. As a result, there are problems in that the power consumption of the drive circuit and the power consumption of the motor for scanning the carriage back and forth increase and energy savings and durability of the liquid discharge apparatus deteriorate due to the life of the motor being shortened.

In contrast to this, Japanese Patent Application Publication No. 2014-184586 discloses a technique for reducing the distorting of the driving waveforms by the carriage being mounted with a drive circuit which is able to perform multilevel charging and discharging of the piezoelectric element and to recover and reuse charge which is discharged from the piezoelectric element. In addition, Japanese Patent Application Publication No. 2014-076567 discloses a technique for reducing the distorting of the driving waveforms by the carriage being mounted with a drive circuit which uses a class D amplifier as the amplification circuit. It is possible for the drive circuit which is described in Japanese Patent Application Publication No. 2014-184586 and the drive circuit which is described in Japanese Patent Application Publication No. 2014-076567 to reduce the size and mounting weight of the carriage and improve the energy savings and durability of the liquid discharge apparatus due to the power consumption and the amount of heat generation being smaller than the drive circuit which is described in Japanese Patent Application Publication No. 2000-343690.

The inventors of the present application discovered that, in a case where the weight of the drive circuit which is mounted on the carriage relative to the weight of the head is too large to ignore, there is a difference in the discharge stability of the ink (liquid) and an effect is imparted onto the printing quality due to the mounting position of the drive circuit. However, while the above-mentioned references disclose that the head and the drive circuit are mounted on the carriage as described above, it is not mentioned at what position the drive circuit is to be mounted on the carriage to be able to realize higher printing quality.

SUMMARY

According to several aspects of the present invention, it is possible to propose a liquid discharge apparatus and a head unit which are able to improve the discharge stability compared to the prior art.

The present invention is carried out in order to solve at least a portion of the problems described above and is able to be realized as the following aspects and applied examples.

Applied Example 1

A liquid discharge apparatus as in this applied example has a head provided with discharge sections which discharge a liquid, a drive circuit configured to generate driving signals for driving the discharge sections and discharging the liquid, a carriage mounted with the head and the drive circuit, and a carriage support section configured and arranged to support the carriage, in which a shortest distance between the carriage support section and the drive circuit is shorter than a shortest distance between the carriage support section and the discharge section which is closest to the carriage support section.

According to the liquid discharge apparatus as in this applied example, due to the drive circuit where the weight is relatively large being arranged close to the carriage support section, it is possible to shorten the distance between the contact point of the carriage and the carriage support section and the center of gravity of a head unit which includes the carriage, the head, and the drive circuit and it is possible to reduce shaking (rattling) when the carriage is moved. Accordingly, according to the liquid discharge apparatus as in this applied example, it is possible to improve the discharge stability due to it being possible to suppress vibration of the head to be small when the liquid is discharged from the discharge sections of the head.

Applied Example 2

In the liquid discharge apparatus as in the applied example described above, the drive circuit is further configured to generate the driving signals using a class D amplifier.

According to the liquid discharge apparatus as in this applied example, it is possible to reduce the size and the mounting weight of the carriage due to the power consumption and the amount of heat generation being smaller compared to a case where the drive circuit generates the driving signals using class AB amplifiers and it not being necessary to mount a heat sink for releasing heat on the carriage. Accordingly, according to the liquid discharge apparatus as in this applied example, it is possible to improve energy savings and it is possible to improve durability due to the life of the motor being lengthened by the load on a motor which scans the carriage back and forth being reduced.

Applied Example 3

In the liquid discharge apparatus as in the applied example described above, the drive circuit is further configured to generate the driving signals using a regeneration circuit using a capacitive element or a secondary battery.

According to the liquid discharge apparatus as in this applied example, it is possible to reduce the size and the mounting weight of the carriage due to the power consumption and the amount of heat generation being smaller compared to a case where the drive circuit generates the driving signals using class AB amplifiers and it not being necessary to mount a heat sink for releasing heat on the carriage. Accordingly, according to the liquid discharge apparatus as in this applied example, it is possible to improve energy savings and it is possible to improve durability due to the life of the motor being lengthened by the load on a motor which scans the carriage back and forth being reduced.

Applied Example 4

In the liquid discharge apparatus as in the applied example described above, the head is provided with a discharge section row which is formed from a plurality of the discharge sections and a supply opening which supplies the liquid to the plurality of discharge sections included in the discharge section row, and a distance between the supply opening and the discharge section which is at the center of the discharge section row is shorter than distances between the supply opening and each of the two discharge sections which are at both ends of the discharge section row.

According to the liquid discharge apparatus as in this applied example, it is possible to shorten the distance from the supply opening to the discharge sections on both ends due to the supply opening being provided at a position which is close to the center of the discharge section row. Accordingly, according to the liquid discharge apparatus as in this applied example, it is possible to further improve the discharge stability due the period of time which is needed for supplying the liquid from the supply opening to the head being shortened and it being difficult for discharge faults due to insufficient supply of liquid to be generated.

Applied Example 5

In the liquid discharge apparatus as in the applied example described above, a distance between the supply opening and the discharge section which is at one end of the discharge section row and a distance between the supply opening and the discharge section which is at the other end of the discharge section row are substantially the same.

"Substantially the same" is not limited to a case where these distances are exactly the same and permits these distances to be different to an extent to which discharge faults due to insufficient supply of liquid are not generated.

According to the liquid discharge apparatus as in this applied example, it is possible to further simplify the structure of the head due to resistance being smaller in the flow path from the supply opening to the discharge sections which are at both ends and it not being a problem if the pressure for supplying the ink from the supply opening is low.

Applied Example 6

A head unit as in this applied example has a head provided with discharge sections which discharge a liquid, a drive circuit configured to generate driving signals for driving the discharge sections and discharging the liquid, a carriage mounted with the head and the drive circuit, and a connection section configured and arranged to connect with a carriage support section which supports the carriage, in which a shortest distance between the connection section and the drive circuit is shorter than a shortest distance between the connection section and the discharge section which is closest to the connection section.

According to the head unit as in this applied example, due to the drive circuit where the weight is relatively large being arranged close to the connection section which connects with the carriage support section, it is possible to shorten the distance between the contact point of the carriage and the carriage support section and the center of gravity of a head unit in a state where the carriage is supported by the carriage support section and it is possible to reduce shaking (rattling) when the carriage is moved. Accordingly, according to the head unit as in this applied example, it is possible to improve the discharge stability due to it being possible to suppress vibration of the head to be small when the liquid is discharged from the discharge sections of the head.

BRIEF DESCRIPTION OF THE DRAWINGS

Referring now to the attached drawings which form a part of this original disclosure.

DETAILED DESCRIPTION OF EXEMPLARY EMBODIMENTS

Appropriate embodiments of the present invention will be described in detail below using the diagrams. The diagrams which are used are for convenience of description. Here, the embodiments which are described below do not unreasonably limited the content of the present invention which is described in the scope of the claims. In addition, all of the configurations which are described below do not limit the essential constituent elements of the present invention.

1. First Embodiment

1-1. Liquid Discharge Apparatus Concept

A printing apparatus which is one example of a liquid discharge apparatus as in the present embodiment is an ink jet printer which forms groups of ink dots on a printing medium such as paper by ink being discharged in accordance with image data which is supplied from an external host computer, and due to this, prints images (which includes text, diagrams, and the like) according to the image data.

Here, it is possible for examples of the liquid discharge apparatus to include, for example, a printing apparatus such as a printer, a colorant material discharge apparatus which is used in manufacturing color filters such as for a liquid crystal display, an electrode material discharge apparatus which is used in forming electrodes for an organic EL display, a field emission display (FED), and the like, a biological organic matter discharge apparatus which are used in bio-chip manufacture, a stereoscopic molding apparatus (a so-called 3D printer), a textile printing apparatus, and the like.

Figure 1:
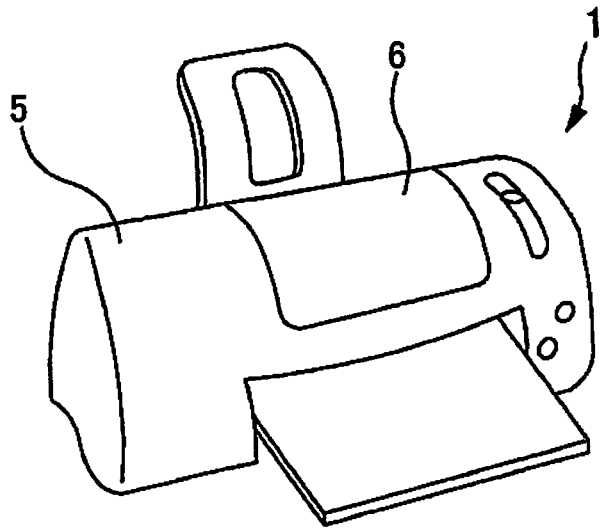
FIG. 1 is a perspective diagram of a liquid discharge apparatus.
Figure 2:
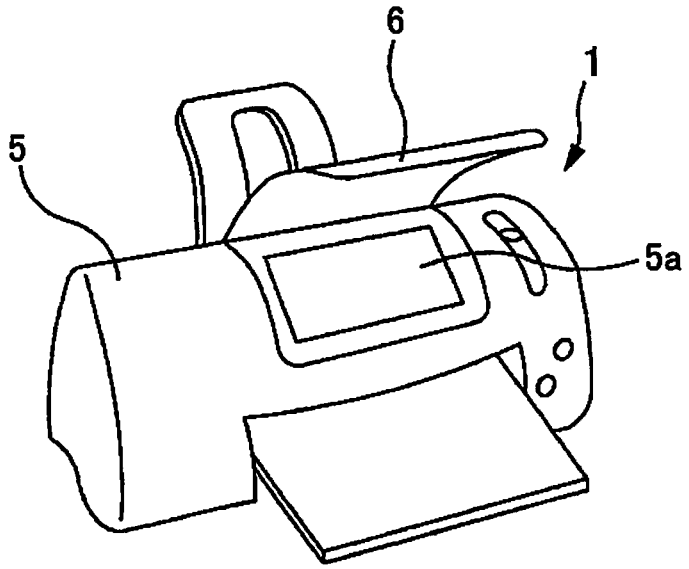
FIG. 2 is a perspective diagram of the liquid discharge apparatus.

FIG. 1 and FIG. 2 are perspective diagrams illustrating a liquid discharge apparatus 1. As shown in FIG. 1 and FIG. 2, the liquid discharge section 1 has a housing 5 and a cover 6 which is provided on the housing 5 so as to be able to be opened and closed. As shown in FIG. 1, an opening section 5*a* is closed off by the cover 6 in a state where the cover 6 is closed. In addition, the opening section 5*a* appears in a state where the cover 6 is open and it is possible for inner sections of the housing 5 to be visible from the opening section 5*a* as shown in FIG. 2.

Figure 3:
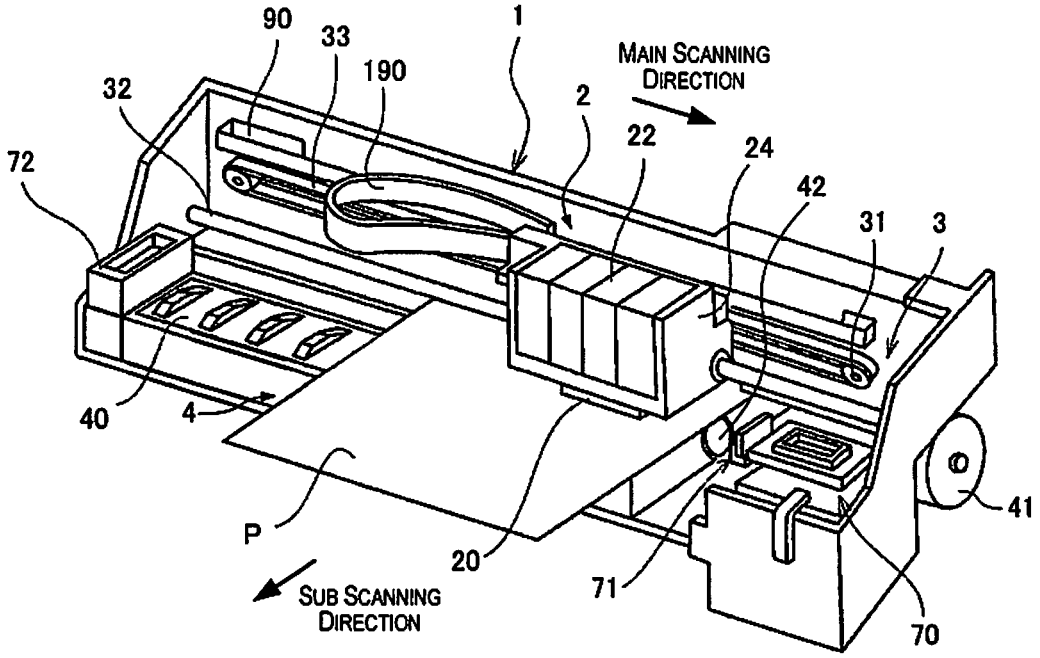
FIG. 3 is a diagram illustrating a schematic configuration of inner sections of the liquid discharge apparatus.

FIG. 3 is a perspective diagram illustrating a schematic configuration of inner sections of the housing 5 of the liquid discharge apparatus 1. In FIG. 3, illustration of the housing 5 and the cover 6 is omitted. As shown in FIG. 3, the liquid discharge apparatus 1 is provided with a head unit 2 and a movement mechanism 3 which moves the head unit 2 (back and forth) in a main scanning direction.

The movement mechanism 3 has a carriage motor 31 which is the drive source for the head unit 2, a carriage guide shaft 32 where both ends are fixed, and a timing belt 33 which extends substantially parallel with the carriage guide shaft 32 and which is driven using the carriage motor 31.

A carriage 24 in the head unit 2 is configured so that it is possible for a specific number of ink cartridges 22 to be loaded. For example, four of the ink cartridges 22 which corresponds to the four colors of yellow, cyan, magenta, and black are mounted in the carriage 24 and are filled with ink of the color which corresponds to each of the ink cartridges 22.

The carriage 24 is supported by the carriage guide shaft 32 so as to be free to move back and forth and is fixed to one portion of the timing belt 33. For this reason, the head unit 2 moves back and forth due to being guided by the carriage guide shaft 32 when the timing belt 33 is run forward and backward by the carriage motor 31. That is, the carriage motor 31 is the motor for moving the carriage 24.

In addition, the movement mechanism 3 is provided with a linear encoder 90 for detecting the position of the head unit 2 in the main scanning direction. The position of the head unit 2 in the main scanning direction is detected using the linear encoder 90.

In addition, a head 20 (a recording head) is provided within the head unit 2 at a portion which opposes a printing medium P. The head 20 is a liquid ejecting head for discharging ink droplets (liquid droplets) from a plurality of nozzles as will be described later, and the head unit 2 is configured so that various types of control signals and the like are supplied via a flexible cable 190.

The liquid discharge apparatus 1 is provided with a transport mechanism 4 which transports the printing medium P on a platen 40 in a sub scanning direction. The transport mechanism 4 is provided with a transport motor 41 which is a drive source and a transport roller 42 which transports the printing medium P in the sub scanning direction by being rotated by the transport motor 41.

Images are formed on the surface of the printing medium P due to the head 20 discharging the ink droplets onto the printing medium P at timings where the printing medium P is being transported by the transport mechanism 4.

A home position which is the starting point for the scanning by the head unit 2 is set at an end section region within the movement range of the head unit 2. A capping mechanism 70 which seals the nozzle formation surface of the head 20 and a wiping member 71 for wiping the nozzle formation surface are arranged at the home position. Then, the liquid discharge apparatus 1 forms an image on the surface of the printing medium P in both directions of forward movement where the head unit 2 moves from the home position towards the end section on the opposite side and backward movement where the head unit 2 returns from the end section on the opposite side to the home position side.

A flushing box 72, which captures ink droplets which are discharged from the head 20 during a flushing operation, is arranged at the end section of the platen 40 in the main scanning direction. A flushing operation is an operation where ink is forcibly discharged from each of the nozzles without any relation to image data which is a printing target in order to prevent appropriate amounts of ink from no longer being discharged due to the nozzles being blocked by an increase in the viscosity of the ink in the vicinity of the ink or bubbles being mixed in the ink inside the nozzles. In detail, the flushing box 72 is arranged on the platen 40 at a region which is outside of a region where ink droplets are discharged (ink discharge region) with regard to the printing medium P, in more detail, at a region which is farther to the outer side of the ink discharge region in the main scanning direction, at a position which, when the printing medium P with the largest size which the liquid discharge apparatus 1 is able to handle is arranged onto the platen 40, is farther to the outer side than the end sections of the printing medium P in the width direction (the maximum recording width). Here, it is desirable for the flushing box 72 to be provided on both sides of the platen 40 in the main scanning direction, but it is sufficient if the flushing box 72 is provided on at least one side.

The head unit 2 is moved to above the printing medium P or above the flushing box 72 and performs operations where ink droplets are discharged toward the printing medium P or flushing operations where ink droplets are discharged toward the flushing box 72.

1-2 Electrical Configuration of Liquid Discharge Apparatus

Figure 4:
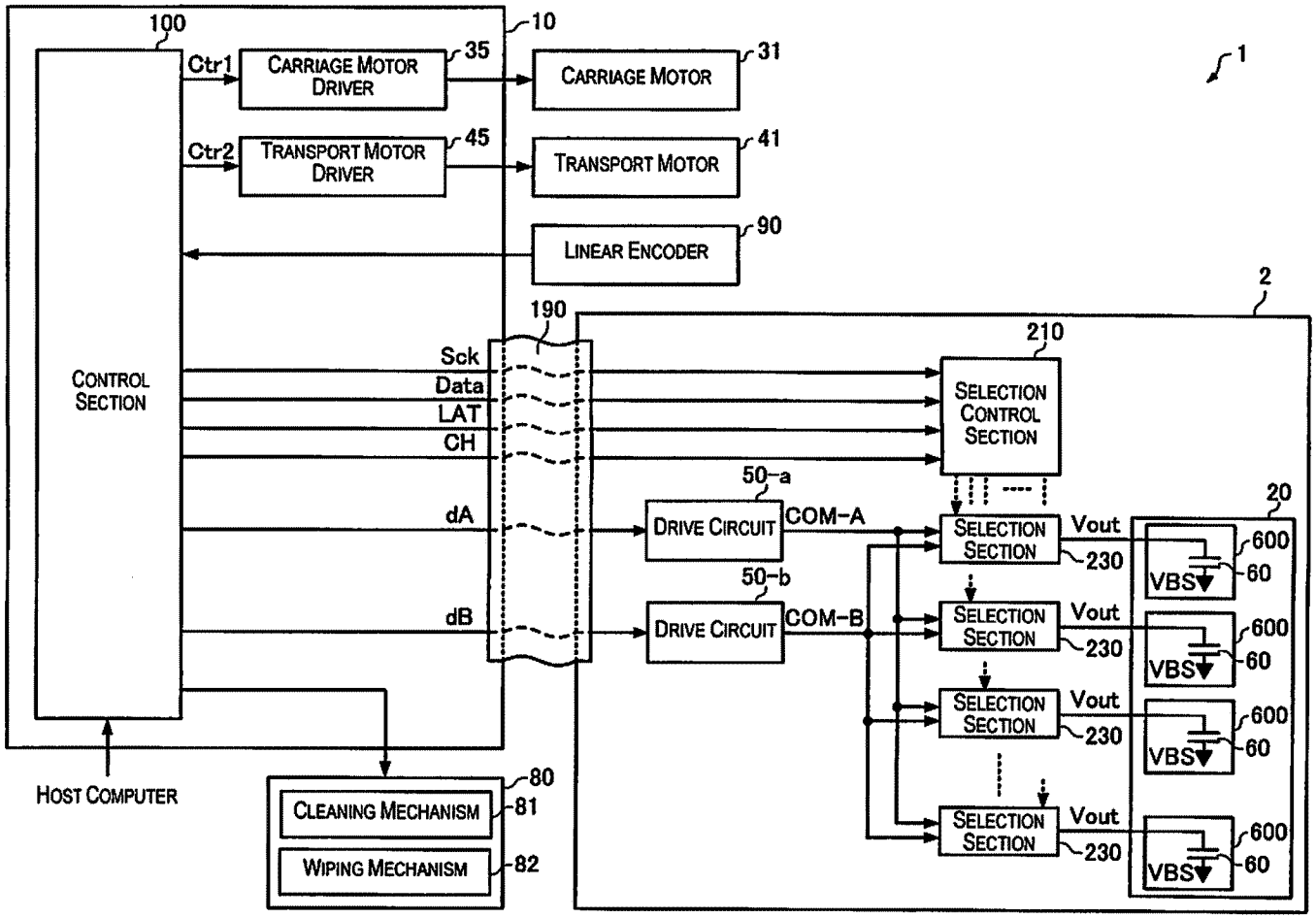
FIG. 4 is a block diagram illustrating an electrical configuration of the liquid discharge apparatus.

FIG. 4 is a block diagram illustrating an electrical configuration of the liquid discharge apparatus 1. As shown in FIG. 4, a control unit 10 and the head unit 2 are connected in the liquid discharge apparatus 1 via the flexible cable 190.

The control unit 10 has a control section 100, a carriage motor driver 35, and a transport motor driver 45. Among these, the control section 100 outputs various types of control signals and the like for controlling each section when image data is supplied from a host computer.

In detail, the control section 100 ascertains the scanning position (the current position) of the head unit 2 based on the detection signal (encoder pulse) from the linear encoder 90. Then, the control section 100 supplies a control signal Ctr1 with regard to the carriage motor driver 35 based on the scanning position of the head unit 2 and the carriage motor driver 35 drives the carriage motor 31 in accordance with the control signal Ctr1. Due to this, movement of the carriage 24 in the main scanning direction is controlled.

In addition, the control section 100 supplies a control signal Ctr2 with regard to the transport motor driver 45 and the transport motor driver 45 drives the transport motor 41 in accordance with the control signal Ctr2. Due to this, movement due to the transport mechanism 4 in the main scanning direction is controlled.

In addition, the control section 100 supplies a clock signal Sck, a data signal Data, control signals LAT and CH, and digital data dA and dB to the head unit 2.

In addition, the control section 100 executes a maintenance process using a maintenance unit 80 in order for the normal ink discharge state to be restored in discharge sections 600. The maintenance unit 80 may have a cleaning mechanism 81 for performing a cleaning process (pumping process) where viscous ink, bubbles, and the like inside the discharge sections 600 are suctioned out using a tube pump (which is omitted from the diagrams) as a maintenance process. In addition, the maintenance unit 80 may have a wiping mechanism 82 for performing a wiping process where foreign bodies such as paper dust which become attached to the vicinity of the nozzles in the discharge sections 600 are wiped away using the wiper 71 as a maintenance process.

The head unit 2 has drive circuits 50-*a* and 50-*b*, a selection control section 210, a plurality of selection sections 230, and the head 20.

Although described in detail later, the drive circuits 50-*a* and 50-*b* generate driving signal COM-A and COM-B for driving the discharge sections 600 which are provided in the head 20 to discharge ink (liquid). In detail, the drive circuit 50-*a* generates the driving signal COM-A where class D amplification is carried out after digital/analog conversion is carried out on the data dA and supplies this to each of the selection sections 230. In the same manner, the drive circuit 50-*b* generates the driving signal COM-B where class D amplification is carried out after digital/analog conversion is carried out on the data dB and supplies this to each of the selection sections 230. Here, out of the driving signals which are supplied to the selection sections 230, the data dA regulates the waveform of the driving signal COM-A and the data dB regulates the waveform of the driving signal COM-B.

With regard to the drive circuits 50-*a* and 50-*b*, only the data which is input and the driving signal which is output are different and the circuit configuration which will be described later is the same. For this reason, in cases where it is not particularly necessary for the drive circuits 50-*a* and 50-*b* to be separately distinguished (for example, in the case explained in FIG. 13 which will be described later), the hyphen and the letter are omitted and the drive circuits 50-*a* and 50-*b* are described simply with the reference numeral "50".

The selection control section 210 instructs which out of the driving signals COM-A and COM-B are to be selected (or which are not to be selected) with regard to each of the selection sections 230 using the clock signal Sck, the data signal Data, and the control signals LAT and CH which are supplied from the control section 100.

Each of the selection sections 230 selects the driving signals COM-A and COM-B in accordance with the instructions from the selection control section 210 and supplies the driving signals COM-A and COM-B as the driving signal to one end of each piezoelectric element 60 in the head 20. Here, the voltage of the driving signals has the notation of Vout in FIG. 4. A voltage VBS is applied in common to the other ends of each of the piezoelectric elements 60.

The piezoelectric elements 60 are displaced due to the driving signals being applied. The piezoelectric elements 60 are provided to correspond to each of the plurality of discharge sections 600 in the head 20. Then, ink is discharged by the piezoelectric elements 60 being displaced according to the difference between the voltage VBS and the voltage Vout of the driving signals which are selected by the selection sections 230. To this point, a configuration for discharging ink through driving of the piezoelectric elements 60 will be simply described next.

1-3 Configuration of Discharge Sections

Figure 5:
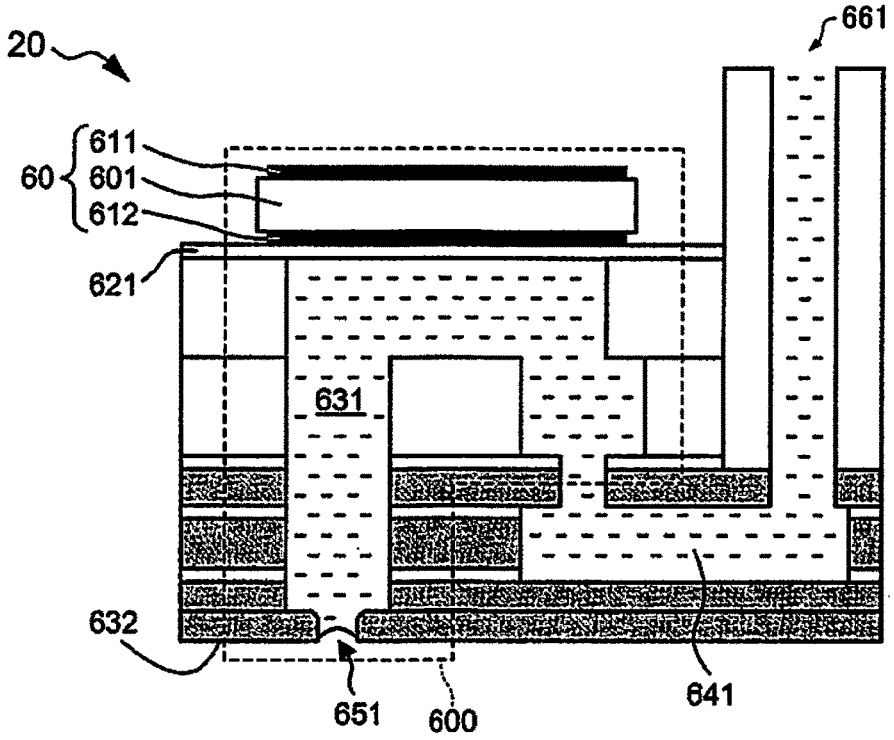
FIG. 5 is a diagram illustrating a configuration of a discharge section in a head.

FIG. 5 is a diagram illustrating a schematic configuration which corresponds to one of the discharge sections 600 in the head 20. The head 20 includes the discharge sections 600 and reservoirs 641 as shown in FIG. 5.

The reservoirs 641 are provided for each color of ink and ink which is retained in an inner section of the ink cartridge 22 is introduced from a supply opening 661 to the reservoirs 641 when the ink cartridge 22 is mounted on the carriage 24.

The discharge section 600 includes the piezoelectric element 60, a vibrating plate 621, a cavity (pressure chamber) 631, and a nozzle 651. Among these, the vibrating plate 621 functions as a diaphragm which is displaced (bent and vibrated) by the piezoelectric element 60 which is provided on the upper surface in the diagram and which expands or contracts the inner capacity of the cavity 631 which is filled with ink. The nozzle 651 is a hole section which is provided in a nozzle plate 632 and which communicates with the cavity 631. An inner section of the cavity 631 is filled with liquid (for example, ink) and the inner capacity of the cavity 631 changes due to the displacement of the piezoelectric element 60. The nozzle 651 communicates with the cavity 631 and the liquid inside the cavity 31 is discharged as liquid droplets according to changes in the inner capacity of the cavity 631.

The piezoelectric element 60 which is shown in FIG. 5 is a structure where a piezoelectric body 601 is interposed by a pair of electrodes 611 and 612. A middle portion of the piezoelectric body 601 with this structure bends with regard to both end sections in the up and down direction in FIG. 5 along with the electrodes 611 and 612 and the vibrating plate 621 according to the voltage which is applied by the electrodes 611 and 612. In detail, the piezoelectric element 60 is configured so as to bend in an upward direction when the voltage of the driving signal Vout is high and to bend in a downward direction when the voltage of the driving signal Vout is low. With this configuration, due to the inner capacity of the cavity 631 expanding when the piezoelectric element 60 bends in an upward direction, ink is drawn in from the reservoir 641, and due to the inner capacity of the cavity 631 contracting when the piezoelectric element 60 bends in a downward direction, ink is discharged from the nozzle 651 to the extent of the contraction.

Here, the piezoelectric element 60 is not limited to the structure which is shown and it is sufficient if the piezoelectric element 60 is a type where it is possible for liquid such as ink to be discharged due to the piezoelectric element 60 changing shape. In addition, the piezoelectric element 60 is not limited to bending and vibrating and may be configured using so-called vertical vibration.

In addition, the piezoelectric elements 60 are provided to correspond to the cavities 631 and the nozzles 651 in the head 20 and the piezoelectric elements 60 are provided to correspond to the selection sections 230 in FIG. 3. For this reason, a set of the piezoelectric element 60, the cavity 631, the nozzles 651, and the selection section 230 are provided for each of the nozzle 651.

1-4 Configuration of Driving Signals

Figure 6:
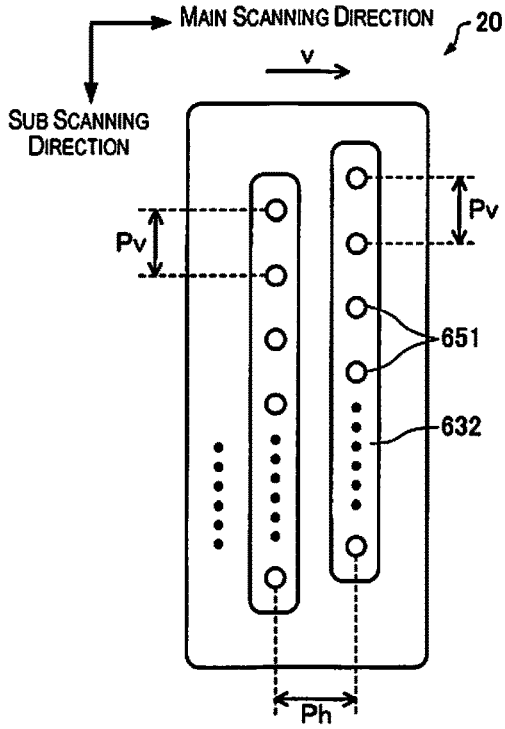
FIG. 6 is a diagram illustrating a nozzle alignment in the head.

FIG. 6 is a diagram illustrating one example of an alignment of the nozzles 651. As shown in FIG. 6, the nozzles 651 are aligned into, for example, two row as follows. In detail, when only looking at one row, there is a relationship in that the nozzles 651 which are a plurality in number are arranged with a pitch Pv along the sub scanning direction and groups of two rows are separated by a pitch Ph in the main scanning direction and are shifted by half of the pitch Pv in the sub scanning direction.

Here, in a case of color printing, the pattern of the nozzles 651 is provided, for example, along the main scanning direction to correspond to each color such as C (cyan), M (magenta), Y (yellow), and K (black), but the case where the gradients are expressed with a single color will be described for simplification of the following description.

Figure 7:
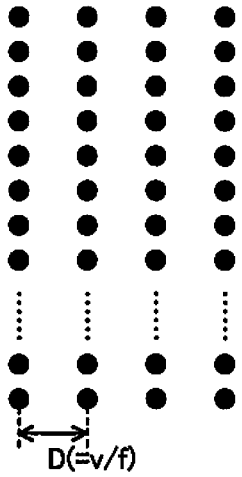
FIG. 7 is a diagram for explaining the basic resolution in image formation using the nozzle alignment which is shown in FIG. 6.

FIG. 7 is a diagram for explaining the basic resolution in image formation using the nozzle alignment shown in FIG. 6. Here, in order to simplify the description, the diagram shows dots where circular black marks are formed by ink droplets landing which is an example of a method (a first method) for forming one dot by ink droplets being discharged once from the nozzles 651.

When the head unit 2 is moved with a velocity v in the main scanning direction, the velocity v and an interval D (in the main scanning direction) between the dots which are formed by ink droplets landing as shown in FIG. 7 have the following relationship.

That is, in a case where one dot is formed by ink droplets being discharged once, the dot interval D is expressed as a value (=v/f) where the velocity v is divided by ink discharge frequency f, in other words, as the distance by which the head unit 2 is moved over a cycle (1/f) over which ink droplets are repeatedly discharged.

Here, in the example in FIG. 6 and FIG. 7, ink droplets which are discharged from two rows of the nozzles 651 land so as to match up in the same one row on the printing medium P with the relationship where the pitch Ph is proportional with regard to the dot interval D with a coefficient n. For this reason, the dot interval in the sub scanning direction is half of the dot interval in the main scanning direction as shown in FIG. 7. It is obvious that the alignment of the dots is not limited to the example in the diagrams.

Here, it is sufficient if the velocity v by which the head unit 2 moves in the main scanning direction is simply high in order for high-speed printing to be realized. However, if the velocity v is just high, the dot interval D becomes longer. For this reason, in order to realize high-speed printing on top of securing a certain degree of resolution, it is necessary for the number of dots which are formed in each unit of time to be increased by increasing the ink discharge frequency f.

In addition, it is sufficient to increase the number of dots which are formed in each unit of time in order to increase the resolution independently of printing speed. However, in cases where the number of dots is increased, adjacent dots do not join up if the ink is not set to a small amount and the printing speed is reduced if the ink discharge frequency f is not high.

In this manner, the necessity to increase the ink discharge frequency f in order to realize high-speed printing and high-resolution printing is as described above.

On the other hand, as the method for forming dots on the printing medium P, as well as the method for forming one dot by ink droplets being discharged once, there is a method (a second method) for forming one dot where two or more of the ink droplets are able to be discharged in a unit of time so that one or more of the ink droplets which are discharge in a unit of time lands and the one or more of the ink droplets which land join up, and a method (a third method) for forming two or more dots without the two or more of the ink droplets joining up. In the following description, a case where dots are formed using the second method described above will be described.

There is description of the present embodiment with the assumption of the second method in the following example. That is, in the present embodiment, the four gradients of large dot, medium dot, small dot, and no recording are expressed by ink for one dot being discharged twice at most. In order for the four gradients to be expressed, there is a first pattern and a second pattern over one cycle for each of the gradients through preparing the two types of the driving signals COM-A and COM-B in the present embodiment. There is a configuration where the driving signals COM-A and COM-B for the first pattern and the second pattern are supplied to the piezoelectric element 60 over one cycle by being selected (or not selected) according to the gradient which is to be expressed.

Therefore, the driving signal COM-A and COM-B will be described and a configuration for selecting the driving signal COM-A and COM-B will be described after this. Here, the driving signal COM-A and COM-B are generated by the drive circuits 50, and a configuration for selecting the driving signal COM-A and COM-B in the drive circuits 50 will be described after this for convenience.

Figure 8:
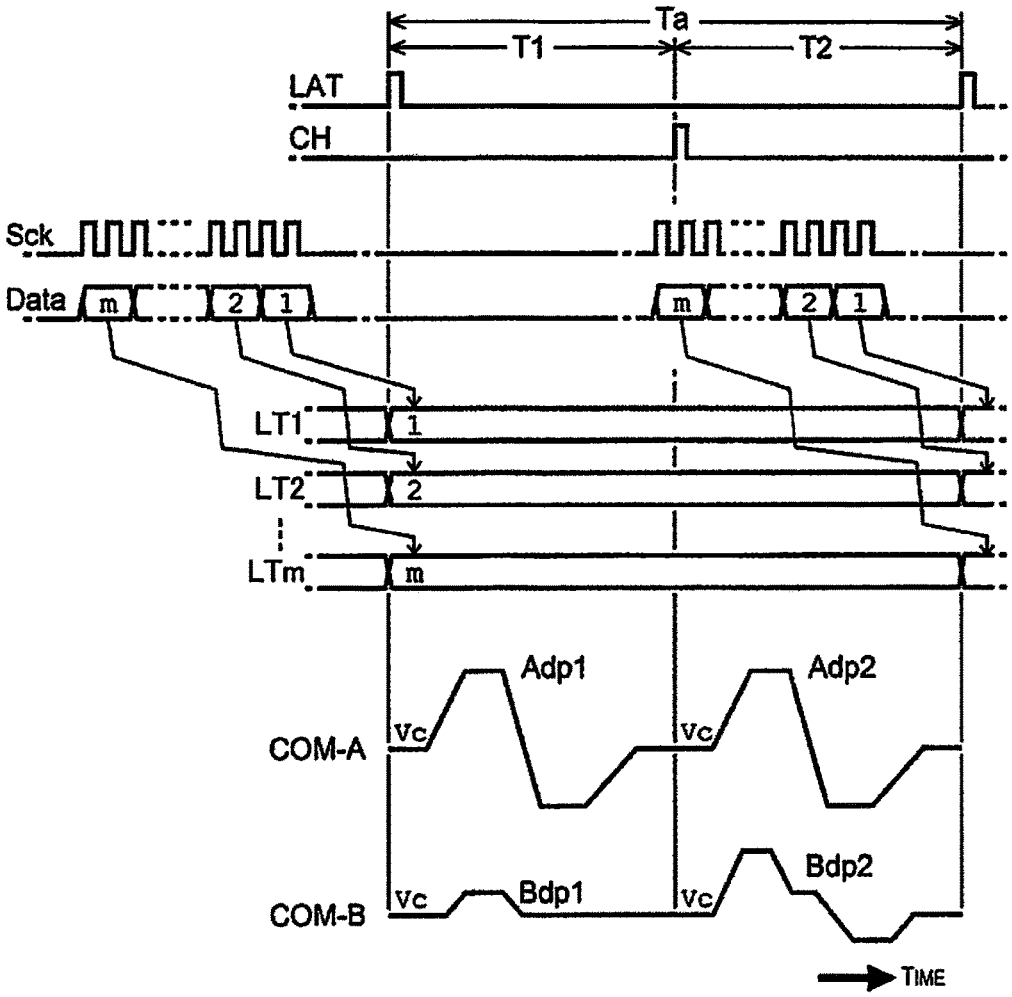
FIG. 8 is a diagram for explaining the operations of a selection control section in a head unit.

FIG. 8 is a diagram illustrating waveforms for the driving signals COM-A and COM-B and the like. As shown in FIG. 8, the driving signal COM-A is a waveform where a trapezoidal waveform Adp1, which is arranged in a time period T1 from when the control signal LAT is output (rises up) to when the control signal CH is output over a printing cycle Ta, and a trapezoidal waveform Adp2, which is arranged in a time period T2 from when the control signal CH is output to when the next control signal LAT is output over the printing cycle Ta, are continuous.

In the present embodiment, the trapezoidal waveforms Adp1 and Adp2 are waveforms which are substantially the same as each other and are waveforms where, if the trapezoidal waveforms Adp1 and Adp2 were to be supplied to one end of the piezoelectric element 60, a specific amount, in more detail, a moderate amount, of ink would be discharged from the nozzle 651 which corresponds to the piezoelectric element 60.

The driving signal COM-B is a waveform where a trapezoidal waveform Bdp1 which is arranged in the time period T1 and a trapezoidal waveform Bdp2 which is arranged in the time period T2 are continuous. In the present embodiment, the trapezoidal waveforms Bdp1 and Bdp2 are waveforms which are different to each other. Out of the trapezoidal waveforms Bdp1 and Bdp2, the trapezoidal waveform Bdp1 is a waveform for preventing increases in the viscosity of the ink by slightly vibrating the ink in the vicinity of the open section of the nozzles 651. For this reason, if the trapezoidal waveform Bdp1 were to be supplied to one end of the piezoelectric element 60, ink droplets would not be discharged from the nozzle 651 which corresponds to the piezoelectric element 60. In addition, the trapezoidal waveform Bdp2 is a waveform which is different to the trapezoidal waveform Adp1 (Adp2). The trapezoidal waveform Bdp2 is a waveform where, if the trapezoidal waveform Bdp2 were to be supplied to one end of the piezoelectric element 60, an amount of ink which is less than the specific amount described above would be discharged from the nozzle 651 which corresponds to the piezoelectric element 60.

Here, the voltage at the timings for the start of the trapezoidal waveforms Adp1, Adp2, Bdp1, and Bdp2 and the voltage at the timings of the end of the trapezoidal waveforms Adp1, Adp2, Bdp1, and Bdp2 are all the same voltage which is a voltage Vc. That is, the trapezoidal waveforms Adp1, Adp2, Bdp1, and Bdp2 are waveforms which each start with the voltage Vc and end with the voltage Vc.

1-5 Configurations of Selection Control Section and Selection Sections

Figures 9, 10:
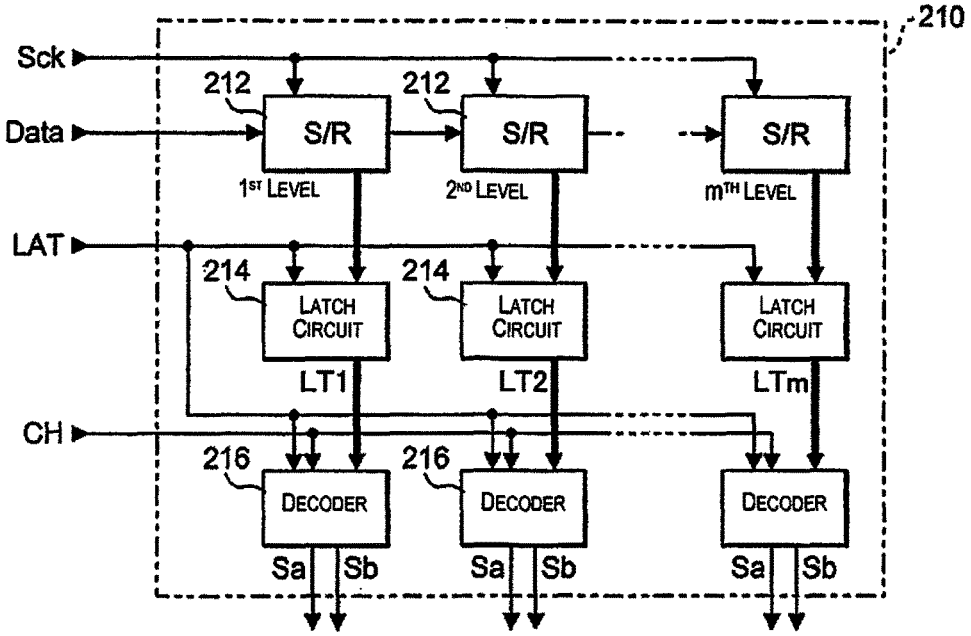
FIG. 9 is a diagram illustrating the configuration of the selection control section in the head unit.
FIG. 10 is a diagram illustrating decoding content for a decoder in the head unit.

FIG. 9 is a diagram illustrating the selection control section 210 in FIG. 4. As shown in FIG. 9, the clock signal Sck, the data signal Data, and the control signals LAT and CH are supplied from the control unit 10 to the selection control section 210. Groupings of a shift register (SIR) 212, a latch circuit 214, and a decoder 216 are provided in the selection control section 210 to correspond to each of the piezoelectric elements 60 (and the nozzles 651).

The data signal Data regulates the size of the dots at a time of forming one dot in an image. Since the four gradients of no recording, small dot, medium dot, and large dot are expressed in the present embodiment, the data signal Data is configured using two bits which are a high-order bit (MSB) and a low-order bit (LSB).

The data signals Data are supplied in a serial manner from the control section 100 to each of the nozzles at the same time as the clock signal Sck to coincide with the main scanning of the head unit 2. The shift register 212 is a configuration for temporarily holding the data signals Data which are supplied in a serial manner as two bits to correspond to the nozzles.

In detail, there is a configuration where the multilevel shift registers 212 which correspond to the piezoelectric elements 60 (the nozzles) are connected to each other in a cascade format and the data signals Data which are supplied in a serial manner are transferred sequentially to the latter levels in accordance with the clock signal Sck.

Here, when the number of the piezoelectric element 60 is m (where m is a number greater than one), the shift registers 212 have the notation of first level, second, . . . , and $m^{th}$ level in order from the upstream side from which the data signals Data are supplied in order to distinguished between the shift registers 212.

The latch circuits 214 latch the data signals Data which are held by the shift registers 212 when the control signal LAT rises up.

The decoders 216 regulate the selection using the selection sections 230 by outputting selection signals Sa and Sb for each of the time periods T1 and T2 which are regulated using the control signal LAT and the control signal CH by decoding the 2-bit data signals Data which are latched using the latch circuits 214.

FIG. 10 is a diagram illustrating decoding content for the decoders 216. The 2-bit data signals Data which are latched have the notation of (MSB and LSB) in FIG. 10. The meaning of the data signal Data which is latched being (0, 1) is that the decoder 216 output the logic levels of the selection signals Sa and Sb respectively at H and L levels in the time period T1 and at L and H levels in the time period T2.

Here, the logic levels of the selection signals Sa and Sb are level shifted to a high amplification logic by level shifters (which are omitted from the diagrams) using the logic levels of the clock signal Sck, the data signal Data, the control signals LAT and CH.

Figure 11:
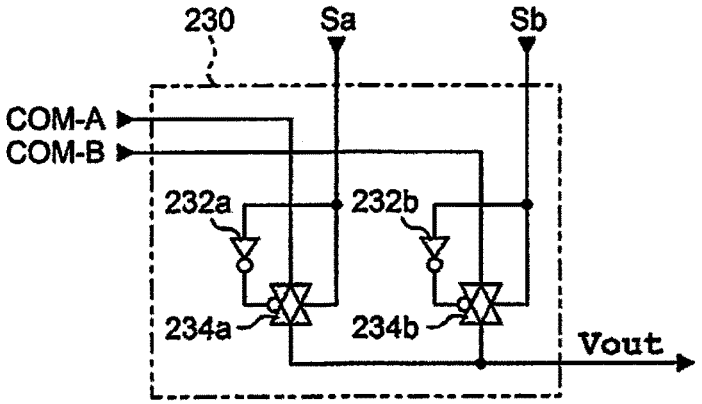
FIG. 11 is a diagram illustrating a configuration of a selection section in the head unit.

FIG. 11 is a diagram illustrating a configuration of the selection section 230 which corresponds to one out of the piezoelectric elements 60 (the nozzle 651) in FIG. 4.

As shown in FIG. 11, the selection section 230 is provided with inverters (NOT circuits) 232*a* and 232*b* and transfer gates 234*a* and 234*b*.

The selection signal Sa from the decoder 216 is supplied to a positive control end where there is no circle mark in the transfer gate 234*a* and is supplied to a negative control end where there is a circle mark in the transfer gate 234*a* due to logic inversion by the inverter 234*a*. In the same manner, the selection signal Sb is supplied to a positive control end in the transfer gate 234*b* and is supplied to a negative control end in the transfer gate 234*b* due to logic inversion by the inverter 234*b*.

The drive signal COM-A is supplied to the input end of the transfer gate 234*a* and the drive signal COM-B is supplied to the input end of the transfer gate 234*b*. The output ends of the transfer gates 234*a* and 234*b* are connected to each other and are connected to one end of the corresponding piezoelectric element 60.

The transfer gate 234*a* conducts (turns on) between the input end and the output end if the selection signal Sa is at the H level and does not conduct (turns off) between the input end and the output end if the selection signal Sa is at the L level. Between the input end and the output end in the transfer gate 234*b* is turned on and off according to the selection signal Sb in the same manner.

Next, the operations of the selection control section 210 and the selection sections 230 will be described with reference to FIG. 8.

The data signal Data is supplied from the control section 100 to each of the nozzles in a serial manner at the same time as the clock signal Sck and are sequentially transferred to the shift registers 212 which correspond to the nozzles. Then, when the control section 100 stops supplying the clock signals Sck, each of the shift registers 212 are in a state of holding the data signals Data which correspond to the nozzles. Here, the data signals Data are supplied to the shift registers 212 in the order which corresponds to the final $m^{th}$ level nozzle, . . . , the second level nozzle, and the first level nozzle.

Here, when the control signal LAT rises up, each of the latch circuits 214 temporarily latch the data signals Data which are held by the shift registers 212. In FIG. 8, LT1, LT2, . . . , and LTm indicate the data signals Data where the data signals Data are latched using the latch circuits 214 which correspond to the first level, second level, . . . , and $m^{th}$ level shift registers 212.

The decoders 216 output the logic level of the selection signals Sa and Sb using content such as shown in FIG. 10 in each of the time periods T1 and T2 according to the size of the dots which are regulated using the data signals Data which are latched.

That is, firstly, the decoder 216 sets the selection signals Sa and Sb to H and L levels in the time period T1 and to H and L levels in the time period T2 in a case where the data signal Data is (1, 1) and regulates for a dot with a large size. Secondly, the decoder 216 sets the selection signals Sa and Sb to H and L levels in the time period T1 and to L and H levels in the time period T2 in a case where the data signal Data is (0, 1) and regulates for a dot with a medium size. Thirdly, the decoder 216 sets the selection signals Sa and Sb to L and L levels in the time period T1 and to L and H levels in the time period T2 in a case where the data signal Data is (1, 0) and regulates for a dot with a small size. Fourthly, the decoder 216 sets the selection signals Sa and Sb to L and H levels in the time period T1 and to L and L levels in the time period T2 in a case where the data signal Data is (0, 0) and regulates for no recording.

Figure 12:
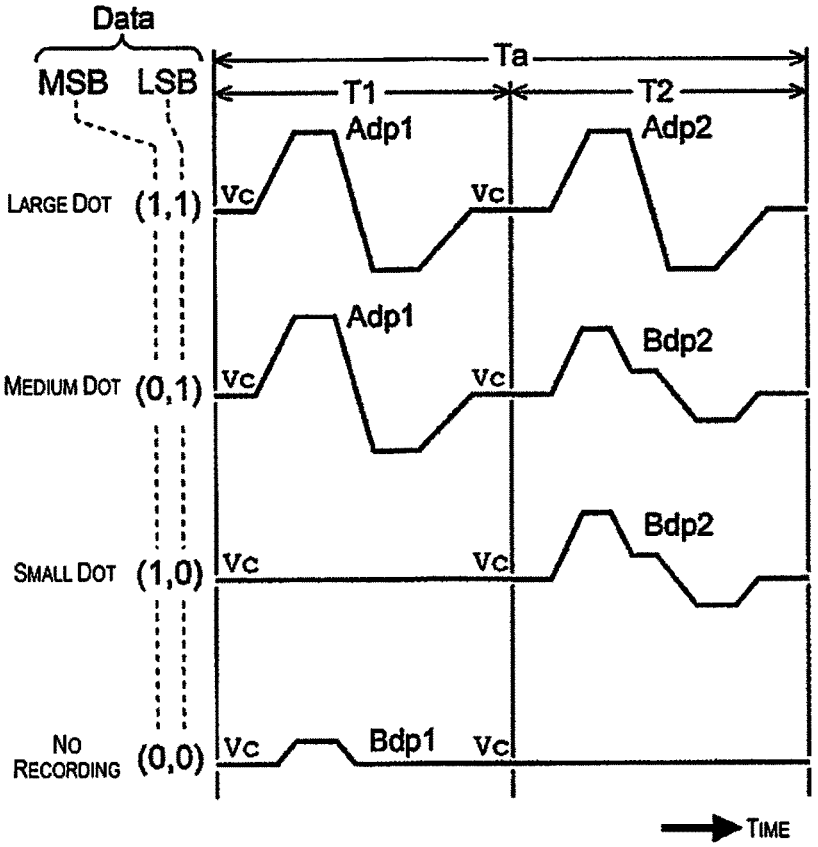
FIG. 12 is a diagram illustrating driving signals which are selected by the selection section.

FIG. 12 is a diagram illustrating the voltage waveforms of the driving signals which are selected according to the data signal Data and supplied to one end of the piezoelectric element 60.

Since the selection signals Sa and Sb are at H and L levels in the time period T1 when the data signal Data is (1, 1), the transfer gate 234*a* is turned on and the transfer gate 234*b* is turned off. For this reason, the trapezoidal waveform Adp1 of the driving signal COM-A is selected in the time period T1. Since the selection signals Sa and Sb are at H and L levels in the time period T2, the selection section 230 selects the trapezoidal waveform Adp2 of the driving signal COM-A.

Due to the trapezoidal waveform Adp1 being selected in the time period T1 and the trapezoidal waveform Adp2 being selected in the time period T2 in this manner, a moderate amount of ink is discharged twice from the nozzle 651 which corresponds to the piezoelectric element 60 when the trapezoidal waveforms Adp1 and Adp2 are supplied to one end of the piezoelectric elements 60 as the driving signal. For this reason, as a result of the ink landing and combining on the printing medium P, a large dot is formed as regulated by the data signal Data.

Since the selection signals Sa and Sb are at H and L levels in the time period T1 when the data signal Data is (0, 1), the transfer gate 234*a* is turned on and the transfer gate 234*b* is turned off. For this reason, the trapezoidal waveform Adp1 of the driving signal COM-A is selected in the time period T1. Next, since the selection signals Sa and Sb are at L and H levels in the time period T2, the trapezoidal waveform Bdp2 of the driving signal COM-B is selected.

Accordingly, a moderate amount of ink and a small amount of ink are discharged twice from the nozzle 651. For this reason, as a result of the ink landing and combining on the printing medium P, a medium dot is formed as regulated by the data signal Data.

Since the selection signals Sa and Sb are at L and L levels in the time period T1 when the data signal Data is (1, 0), the transfer gate 234*a* and the transfer gate 234*b* are turned off. For this reason, neither of the trapezoidal waveforms Adp1 and Bdp1 is selected in the time period T1. In a case where the transfer gate 234*a* and the transfer gate 234*b* are both off, the path from the connection point between the output ends of the transfer gates 234*a* and 234*b* and the one end of the piezoelectric element 60 is in a state of high impedance where no portions are electrically connected. Here, the piezoelectric element 60 holds the voltage (Vc-VBS) immediately before the transfer gates 234*a* and 234*b* are turned off using the capacity of the piezoelectric element 60.

Next, since the selection signals Sa and Sb are at L and H levels in the time period T2, the trapezoidal waveform Bdp2 of the driving signal COM-B is selected. For this reason, since only a small amount of ink is discharged from the nozzle 651 in the time period 17, a small dot is formed on the printing medium P as regulated by the data signal Data.

Since the selection signals Sa and Sb are at L and H levels in the time period T1 when the data signal Data is (0, 0), the transfer gate 234*a* is turned off and the transfer gate 234*b* is turned on. For this reason, the trapezoidal waveform Bdp1 of the driving signal COM-B is selected in the time period T1. Next, since the selection signals Sa and Sb are both at L levels in the time period T2, neither of the trapezoidal waveforms Adp2 and Bdp2 is selected.

For this reason, since ink in the vicinity of the opening section of the nozzle 651 only vibrates slightly and ink is not discharged in the time period T1, a dot is not formed as a result, that is, there is no recording as regulated by the data signal Data.

In this manner, the selection sections 230 select (or do not select) the driving signals COM-A and COM-B and supplied to one end of the piezoelectric elements 60 in accordance with instructions from the selection control section 210. For this reason, each of the piezoelectric elements 60 is driven according to the size of the dot which is regulated using the data signal Data.

Here, the driving signals COM-A and COM-B which are shown in FIG. 8 are only but one example. Combinations of various waveforms which are prepared in advance are used in practice according to the movement velocity of the head unit 2, the properties of the printing medium P, and the like.

In addition, here, an example is described where the piezoelectric elements 60 bend in an upward direction in accordance with an increase in the voltage, but the piezoelectric elements 60 bend in a downward direction in accordance with an increase in the voltage when the voltage which is supplied to the electrodes 611 and 612 is inverted. For this reason, in a configuration where the piezoelectric elements 60 bend in a downward direction in accordance with an increase in the voltage, the driving signals COM-A and COMB which are given as examples in FIG. 12 are waveforms which are inverted with the voltage Vc as a reference.

In this manner, one dots is formed with regard to the printing medium P with the printing cycle Ta which is a unit time period as a unit in the present embodiment. For this reason, in the present embodiment where one dot is formed due to ink droplets being discharged twice (at most) over the printing cycle Ta, the ink discharge frequency f is 2/Ta and the dot interval D is a value where the velocity v with which the head unit 2 moves is divided by the ink discharge frequency f (=2/Ta).

In a case where it is possible for ink droplets to be discharged Q times (where Q is an integer of two or more) over the unit time period T and where one dot is formed by ink droplets being discharged Q times, it is possible for the ink discharge frequency f to be typically represented as Q/T.

In a case where dots are formed in different sizes on the printing medium P as in the present invention, it is necessary for the period of time for one time of ink droplets to be discharged once to be shortened even when the period of time (cycle) needed for forming one dot is the same compared to a case where one dot is formed by one time of ink droplets being discharged.

Here, there is no need for special description of the third method where two or more dots are formed without joining of the two or more ink droplets.

1-6 Configuration of Drive Circuits

Next, the drive circuits 50-*a* and 50-*b* will be described. The driving signal COM-A is generated in the following manner when summarizing using the drive circuit 50-*a* which is one out of the drive circuits 50-*a* and 50-*b*. That is, first, the drive circuit 50-*a* converts the data dA which is supplied from the control section 100 into analog, second, feeds back the driving signal COM-A which is output, feeds back the output driving signal COM-A, corrects deviation between the signal which is based on the driving signal COM-A (the attenuated signal) and the target signal using the high-frequency component of the driving signal COM-A, and generates a modulation signal in accordance with the signal which is corrected, third, generates an amplified modulation signal by switching a transistor in accordance with the modulation signal, and fourth, smooths (demodulates) the amplified modulation signal using a low path filter and outputs the signal which is smoothed as the driving signal COM-A.

The drive circuit 50-*b* which is other one out of the drive circuits 50-*a* and 50-*b* is configured in the same manner and only differs with regard to the point in that the driving signal COM-B is output from the data dB. Therefore, in FIG. 13, the drive circuits 50-*a* and 50-*b* are described as the drive circuits 50 without being distinguished as the drive circuits 50-*a* and 50-*b*.

Here, the data which is input and the driving signals which are output uses the notation of dA (dB) and COM-A (COM-B) and are expressed such that the data dA is input and the driving signal COM-A is output in the case of the drive circuit 50-*a* and the data dB is input and the driving signal COM-B is output in the case of the drive circuit 50-*b*.

Figure 13:
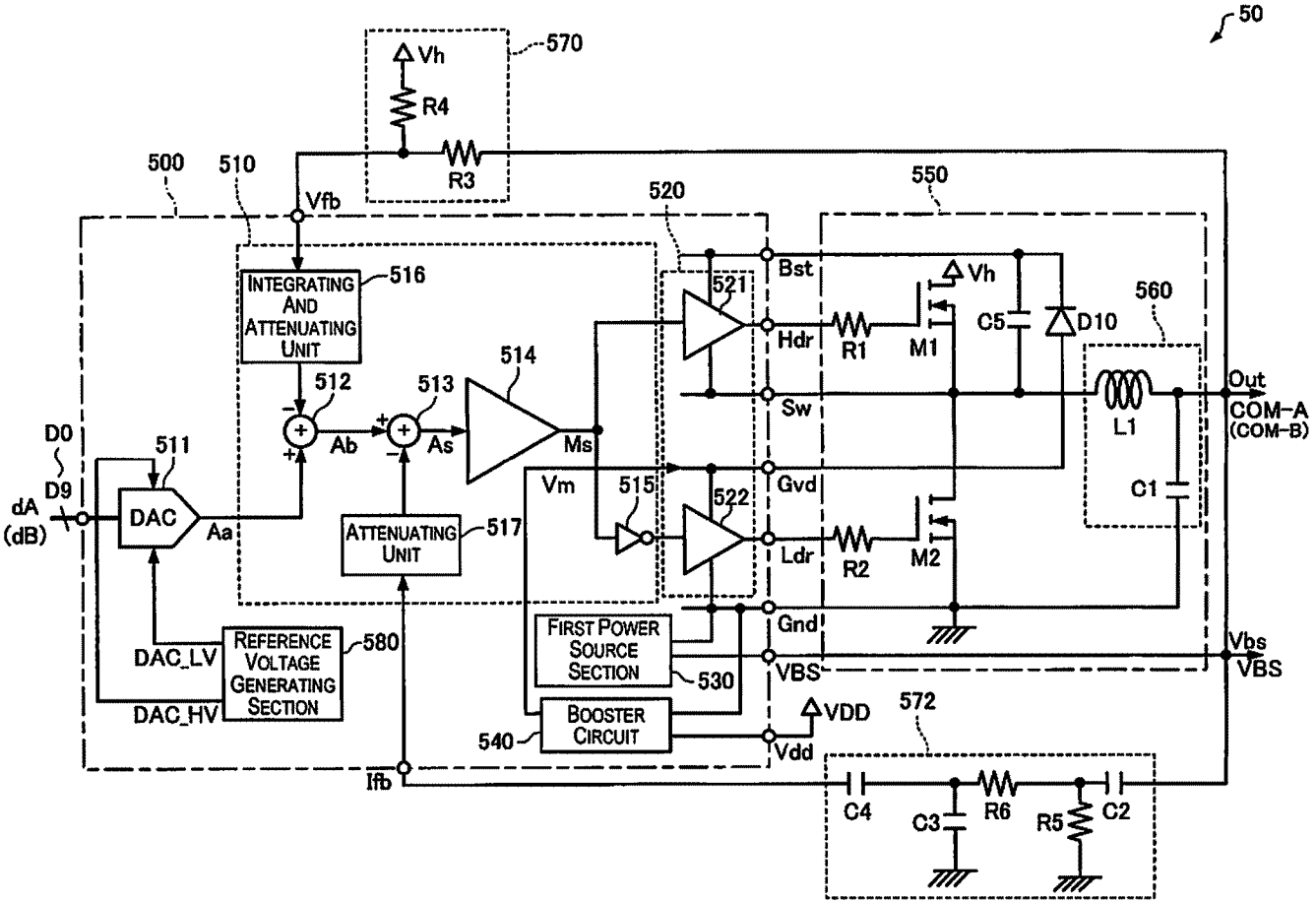
FIG. 13 is a diagram illustrating the circuit configuration of a drive circuit (capacitive load drive circuit).

FIG. 13 is a diagram illustrating the circuit configuration of the driving circuit (capacitive load drive circuit) 50. Here, the configuration for outputting the driving signal COM-A is shown in FIG. 13.

As shown in FIG. 13, the drive circuit 50 is configured from the integrated circuit apparatus (capacitive load driving integrated circuit) 500 and an output circuit 550 as well as various types of elements such as a resistor and a capacitor.

The driving circuit 50 in the present embodiment is provided with a modulation section 510 which generates a modulation signal where the pulse of the original signal is modulated, a gate driver 520 which generates an amplified control signal based on the modulation signal, transistors (a first transistor M1 and a second transistor M2) which generate an amplified modulation signal where the modulation signal is amplified based on the amplified modulation signal, a low pass filter 560 which generates a driving signal by demodulating the amplified modulation signal, feedback circuits (a first feedback circuit 570 and a second feedback circuit 572) which feeds back the driving signal to the modulation section 510, and a booster circuit 540. In addition, the drive circuit 50 may be provided with a first power source section 530 where a signal is applied to a terminal which is different to the terminal to which the driving signal of the piezoelectric element 60 is applied.

The integrated circuit apparatus 500 in the present embodiment is provided with the modulation section 510 and the gate driver 520.

The integrated circuit apparatus 500 outputs gate signals (amplified control signals) to the first transistor M1 and the second transistor M2 based on 10 bits of the data dA (the original signal) which is input from the control section 100 via terminals D0 to D9. For this reason, the integrated circuit apparatus 500 includes a digital to analog converter (DAC) 511, an accumulator 512, an accumulator 513, a comparator 514, an integrating and attenuating unit 516, an attenuator 517, an inverter 515, a first gate driver 521, a second gate driver 522, the first power source section 530, the booster circuit 540, and a reference voltage generating section 580.

The reference voltage generating section 580 generates a first reference voltage DAC_HV (a high-voltage reference voltage) and a second reference voltage DAC_LV (a low-voltage reference voltage) and supplies the reference voltages to the DAC 511.

The DAC 511 converts the data dA which regulates the waveform of the driving signal COM-A to an original driving signal Aa with a voltage which is between the first reference voltage DAC-HV and the second reference voltage DAC-LV and supplies the original driving signal Aa to the input terminal (+) of the accumulator 512. Here, the maximum value and the minimum value for the amplitude of the voltage of the original driving signal Aa (for example, approximately 1-2 V) is determined by the first reference voltage DAC-HV and the second reference voltage DAC-LV, and the driving signal where the voltage is amplified is the driving signal COM-A. That is, the original driving signal Aa is a signal with a target of being the driving signal COM-A before amplification.

The integrating and attenuating unit 516 attenuates and integrates the voltage at a terminal Out which is input via a terminal Vfb, that is, the driving signal COM-A and supplies the driving signal COM-A to the input terminal (−) of the accumulator 512.

The accumulator 512 supplies a signal Ab with a voltage which is integrated by the voltage at the input terminal (−) being subtracted from the voltage at the input terminal (+) to the input terminal (+) of the accumulator 513.

Here, the power source voltage for the circuits from the DAC 511 to the inverter 515 is 3.3 V with a low amplitude (a voltage Vdd which is supplied from a power source terminal Vdd). For this reason, since there are cases where the voltage of the driving signal COM-A exceeds 40V when at the maximum while the voltage of the original driving signal Aa is approximately 2 V when at the maximum, the voltage of the driving signal COM-A is attenuated using the integrating and attenuating unit 516 so that the amplitude range of both voltages matches at the time of determining the deviation.

The attenuator 517 attenuates the high-frequency component of the driving signal COM-A which is input via a terminal Ifb and supplies the driving signal COM-A to the input terminal (−) of the accumulator 513. The accumulator 513 supplies a signal As with a voltage where the voltage at the input terminal (−) is subtracted from the voltage at the input terminal (+) to the comparator 514. The function of the attenuator 517 is to adjust the modulation gain (sensitivity). That is, the frequency and duty ratio of the modulation signal Ms changes along with the data dA (the power source signal), but the attenuator 517 adjusts the amount of change.

The voltage of the signal As which is output from the accumulator 513 is a voltage where the attenuated voltage of the signal which is supplied to the terminal Ifb is subtracted by the attenuated voltage of the signal which is supplied from the terminal Vfb being subtracted from the voltage of the original driving signal Aa. For this reason, it is possible for the voltage of the signal As due to the accumulator 513 to be a signal where the deviation, where the attenuated voltage of the driving signal COM-A which is output from the terminal Out is subtracted from the voltage of the original driving signal Aa which is the target, is corrected using the high-frequency components of the driving signal COM-A.

The comparator 514 outputs a modulation signal Ms where the pulse is modulated in the following manner based on the subtraction voltage due to the accumulator 513. In detail, the comparator 514 outputs the modulation signal Ms which is the H level when the signal As which is output from the accumulator 513 is equal to or more than a voltage threshold Vth1 when the voltage is rising and which is at the L level when the signal As which is output from the accumulator 513 is equal to or less than a voltage threshold Vth2 when the voltage is falling. Here, as will be described later, the voltage thresholds are set with a relationship where Vth1>Vth2.

The modulation signal Ms due to the comparator 514 is supplied to the second gate driver 522 through a logic inversion using the inverter 515. On the other hand, the modulation signal Ms is supplied without undergoing a logic inversion in the first gate driver 521. For this reason, the logic levels which are supplied to the first gate driver 521 and the second gate driver 522 have a relationship of being exclusive to each other.

The logic levels which are supplied to the first gate driver 521 and the second gate driver 522 may be timing controls so as to not both be at H levels at the same time in practice (so that the first transistor M1 and the second transistor M2 are not on at the same time). For this reason, exclusive has the meaning in a strict sense of not being at H levels at the same time (so that the first transistor M1 and the second transistor M2 are not on at the same time).

However, the modulation signal which is referred to here is the modulation signal Ms in a strict sense, but a negation signal for the modulation signal Ms is included as the modulation signal Ms when considering pulse modulation according to the original driving signal Aa. That is, not only is the modulation signal Ms included in the modulation signal where the pulse is modulated according to the original driving signal Aa but modulation signals where the logic level of the modulation signal Ms is inverted or modulation signals where the timing is controlled are also included.

Here, since the comparator 514 outputs the modulation signal Ms, the circuits up until the comparator 514 or the inverter 515, that is, the accumulator 512, the accumulator 513, the comparator 514, the inverter 515, the integrating and attenuating unit 516, and the attenuator 517 are equivalent to the modulation section 510 which generates the modulation signal.

The first gate driver 521 is output from a terminal Hdr by level shifting the low amplitude logic which is the output signal from the comparator 514 to a high amplitude logic. Out of the power source voltages from the first gate driver 521, the high side is a voltage which is applied via a terminal Bst and the low side is a voltage which is applied via a terminal Sw. The terminal Bst is connected to an end of a capacitive element C5 and the cathode terminal of a diode D10 for preventing reverse flow. The terminal Sw is connected to the source electrode of the first transistor M1, the drain electrode of the second transistor M2, the other end of the capacitive element C5, and an end of an inductor L1. The anode electrode of the diode D10 is connected to one end of a terminal Gvd and a voltage Vm (for example, 7.5 V), which is output from the booster circuit 340, is applied. Accordingly, the potential difference between the terminal Bst and the terminal Sw is approximately equal to the potential difference between both ends of the capacitive element C5, that is, the voltage Vm (for example, 7.5 V).

The second gate driver 522 operates on a lower potential side than the first gate driver 521. The second gate driver 522 outputs from a terminal Ldr by level shifting the low amplitude logic (for example, L level: O V, H level: 3.3 V) which is the output signal from the inverter 515 to a high amplitude logic (for example, L level: O V, H level: 7.5 V). Out of the power source voltages from the second gate driver 522, the voltage Vm (for example, 7.5 V) is applied as the high side and a voltage of zero is applied via a ground terminal Gnd as the low side, that is, the ground terminal Gnd is connected to the ground. In addition, the terminal Gvd is connected to the anode electrode of the diode D10.

The first transistor M1 and the second transistor M2 are, for example, N channel type field effect transistors (FED. Out of the transistors, in the first transistor M1 which is the high side, a voltage Vh (for example, 42 V) is applied to the drain electrode and the gate electrode is connected to the terminal Hdr via a resistor R1. In the second transistor M2 which is the low side, the gate electrode is connected to the terminal Ldr via a resistor R2 and the source electrode is connected to the ground.

Accordingly, when the first transistor M1 is off and the second transistor M2 is on, the voltage at the terminal Sw is 0 V and the voltage Vm (for example, 7.5 V is applied to the terminal Bst. On the other hand, when the first transistor M1 is on and the second transistor M2 is off, the voltage Vh (for example, 42 V) is applied to the terminal Sw, and Vh+Vm (for example, 49.5 V) is applied to the terminal Bst.

That is, since the reference potential (the potential at the terminal Sw) changes to 0 V or Vh (for example, 42 V) according to the operation of the first transistor M1 and the second transistor M2 by the floating power source of the capacitive element C5, the first gate driver 521 outputs an amplified control signal where the L level is close to 0 V and the H level is close to Vm (for example, 7.5 V) or the L level is Vh (for example, 42 V) and the H level is close to Vh+Vm (for example, 49.5 V). In contrast to this, since the reference potential (the potential at the ground terminal Gnd) is fixed at 0 V without any relation to the operations of the first transistor M1 and the second transistor M2, the second gate driver 522 outputs an amplified control signal where the L level is close to 0 V and the H level is close to Vm (for example, 7.5 V).

The other end of the inverter L1 is the terminal Out which is the output to the driving circuit 50 and supplies the driving signal COM-A from the terminal Out to each of the selection sections 230.

The terminal Out is connected to one end of the capacitive element C1, one end of the capacitive element C2, and one end of a resistor R3. Out of these, the other end of the capacitive element C1 is connected to the ground. For this reason, the inverter L1 and the capacitive element C1 function as a low pass filter which smooths the amplified modulation signal which arrives at the connection point between the first transistor M1 and second transistor M2.

The other end of the resistor R3 is connected to the terminal Vfb and one end of a resistor R4 and the voltage Vh is applied to the other end of the resistor R4. Due to this, the driving signal COM-A which is from the terminal Out and passes through the first feedback circuit 570 (a circuit which is configured by the resistor R3 and the resistor R4) is pulled up and fed back in the terminal Vfb.

On the other hand, the other end of the capacitive element C2 is connected to one end of a resistor R5 and one end of a resistor R6. Out of these, the other end of the resistor R5 is connected to the ground. For this reason, the capacitive element C2 and the resistor R5 function as a high pass filter which permits passing through of high-frequency components, which are equal to or higher than a cutoff frequency, of the driving signal COM-A from the terminal Out. Here, the cutoff frequency of the high pass filter is set to, for example, approximately 9 MHz.

In addition, the other end of the resistor R6 is connected to one end of a capacitive element C4 and one end of a capacitive element C3. Out of these, the other end of the capacitive element C3 is connected to the ground. For this reason, the resistor R6 and the capacitive element C3 function as a low pass filter which permits passing through of low-frequency components, which are equal to or less than a cutoff frequency, of the signal components which pass through the high pass filter. Here, the cutoff frequency of the low pass filter is set to, for example, approximately 160 MHz.

Since the cutoff frequency of the high pass filter is set to be lower than the cutoff frequency of the low pass filter, the high pass filter and the low pass filter function as a band pass filter which permits passing through of high-frequency components of the driving signal COM-A within a specific frequency band.

The other end of the capacitive element C4 is connected to the terminal Ifb of the integrated circuit apparatus 500. Due to this, the direct current component in the high-frequency components of the driving signal COM-A which passes through the second feedback circuit 572 (a circuit which is configured by the capacitive element C2, the resistor R5, the resistor R6, the capacitive element C3, and the capacitive element C4) which functions as a band pass filter, is cut off and fed back in the terminal Ifb.

Here, the driving signal COM-A which is output from the terminal Out is a signal where the amplified modulation signal at the connection point (the terminal Sw) of the first transistor M1 and the second transistor M2 is smoothed using the low pass filter which is formed from the inverter L1 and the capacitive element C1. Since the driving signal COM-A is fed back to the accumulator 512 after integration and subtraction via the terminal Vfb, there is self-excited oscillation at a frequency which is determined by the delay in feedback (the sum of delays due to smoothing by the inverter L1 and the capacitive element C1 and delays due to the integrating and attenuating unit 516) and the feedback transfer function.

However, there are cases where it is not possible to increase the frequency of self-excited oscillation enough so that it is possible to secure sufficient accuracy of the driving signal COM-A with only feeding back via the terminal Vfb since the amount of delay in the feedback path via the terminal Vfb is large.

Therefore, in the present embodiment, the delays over the whole of the circuitry is reduced by providing a path where the high-frequency components of the driving signal COM-A is fed back via the terminal Ifb which is separate to the path via the terminal Vfb. For this reason, the frequency of the signal As where the high-frequency component of the driving signal COM-A is added to the signal Ab is increased so that it is possible to secure sufficient accuracy of the driving signal COM-A in comparison to a case where a path via the terminal Ifb is not provided.

Figure 14:
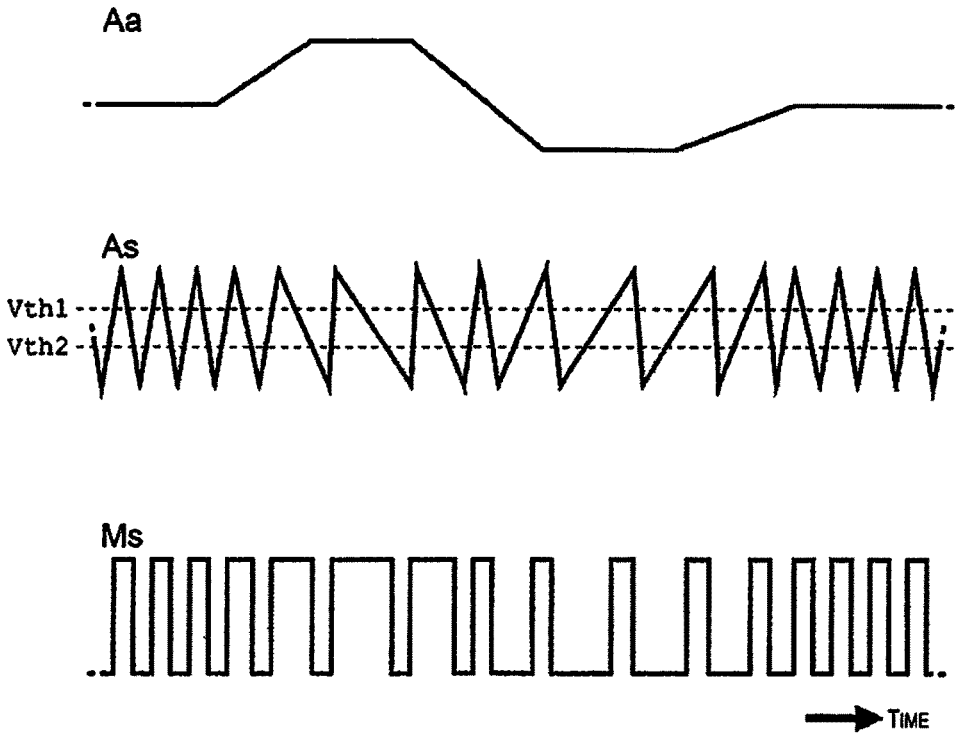
FIG. 14 is a diagram for explaining the operations of the drive circuit.

FIG. 14 is a diagram illustrating the relationship between the waveforms for the signal As and the modulation signal Ms and the waveform of the original driving circuit Aa.

As shown in FIG. 14, the signal As is a triangular wave and the oscillation frequency varies according to the voltage (the input voltage) of the original driving signal Aa. In detail, the signal As is highest in cases where the input voltage is a moderate value and falls as the input voltage increases from the moderate value or decreases from the moderate value.

In addition, the slope of the triangular waveform of the signal As is substantially equal when rising (when the voltage is rising) or falling (when the voltage is falling) if the input voltage is around a moderate value. For this reason, the duty ratio of the modulation signal Ms, which is the result of comparing the voltage thresholds Vth1 and Vth2 using the comparator 514, is approximately 50%. The downward slope of the signal As becomes flatter as the input value rises from the moderate value. For this reason, the duty ratio becomes higher as the time period over which the modulation signal Ms is at the H level becomes relatively longer. On the other hand, the upward slope of the signal As becomes flatter as the input value is lowered from the moderate value. For this reason, the duty ratio becomes smaller as the time period over which the modulation signal Ms is at the H level becomes relatively shorter.

For this reason, the modulation signal Ms becomes a pulse density modulation signal as in the following manner. That is, the duty ratio of the modulation signal Ms is approximately 50% with the input value at the moderate value, increases as the input value rises from the moderate value, and falls as the input value is lowered from the moderate value.

The first gate driver 521 turns the first transistor M1 on and off based on the modulation signal Ms. That is, the first gate driver 521 turns the first transistor M1 on if the modulation signal Ms is at the H level and turns the first transistor M1 off if the modulation signal Ms is at the L level. The second gate driver 522 turns the second transistor M2 on and off based on the logic inversion signal of the modulation signal Ms. That is, the second gate driver 522 turns the second transistor M2 off if the modulation signal Ms is at the H level and turns the second transistor M2 on if the modulation signal Ms is at the L level.

Accordingly, since the voltage of the driving signal COM-A, where the amplified modulation signal at the connection point of the first transistor M1 and the second transistor M2 is smoothed using the inverter L1 and the capacitive element C1, increases as the duty ratio of the modulation signal Ms rises and falls as the duty ratio of the modulation signal Ms is lower, the driving signal COM-A is controlled and output as a result of this so as to be a signal where the voltage of the original driving signal Aa becomes larger.

There is an advantage in that the width of variation in the duty ratio is taken to be larger in comparison to pulse width modulation where the modulation frequency is fixed since the drive circuit 50 uses pulse density modulation.

That is, it is only possible to secure a specific range (for example, a range from 10% to 90%) as the width of variation in the duty ratio in pulse width modulation with a fixed frequency since the minimum positive pulse width and negative pulse width which are possible when dealing with the entire circuitry is limited by the characteristics of the circuitry. In contrast to this, it is possible for the duty ratio to be larger over a region where the input voltage is high and it is possible for the duty ratio to be smaller over a region where the input voltage is low since the oscillation frequency is lower as the input voltage is father from the moderate value in pulse density modulation. For this reason, it is possible to secure a wider range (for example, a range from 5% to 95%) as the width of variation in the duty ratio in pulse width modulation with self-excited oscillation.

In addition, the drive circuit 50 includes a signal path which transfers the driving signal COM-A, the modulation signal Ms, and the amplified modulation signal and is a self-oscillating circuit which self oscillates, and a circuit which generates carrier waves at a high frequency such as separately-excited oscillation is not necessary. For this reason, there is an advantage in that integration of the circuits other than the circuits which handle high voltages, that is, the sections of the integrated circuit apparatus 500, is easy.

Additionally, since there is not only a path via the terminal Vfb as the feedback path for the driving signal COM-A in the drive circuit 50 but also a path where the high-frequency components are fed back via the terminal Ifb, the delays over the whole of the circuitry is reduced. For this reason, it is possible for the drive circuit 50 to generate the driving signal COM-A more precisely since the frequency of the self-excited oscillation is higher.

Returning to FIG. 13, the resistor R1, the resistor R2, the first transistor M1, the second transistor M2, the capacitive element C5, the diode D10, and the low pass filter 560 are configured in the example which is shown in FIG. 13 as the output circuit 550 which outputs a capacitive load (the piezoelectric element 60) by generating an amplified control signal based on the modulation signal and generating a driving signal based on the amplified control signal.

The first power source section 530 applies a signal to a terminal which is different to the terminal to which the driving signal from the piezoelectric element 60 is applied. The first power source section 530 is configured using, for example, a fixed voltage circuit such as a bandgap reference circuit. The first power source section 530 outputs a voltage VBS from a terminal Vbs. In the example which is shown in FIG. 13, the first power source section 530 generates the voltage VBS with the ground potential at the ground terminal Gnd as a reference.

The booster circuit 540 supplies the power source to the gate driver 520. In the example which is shown in FIG. 13, the booster circuit 540 boosts the voltage Vdd which is supplied from the power source terminal Vdd with the ground potential at the ground terminal Gnd as a reference and generates the voltage Vm which is the power source voltage on the high side of the second gate driver 522. It is possible for the booster circuit 540 to be configured using a charge pump circuit, a switching regulator, or the like, but it is possible to suppress the generation of noise when the booster circuit 540 is configured using a charge pump circuit compared to a case where the booster circuit 540 is configured using a switching regulator. For this reason, it is possible to improve the liquid discharge accuracy since it is possible for the drive circuit 50 to generate the driving signal COM-A more precisely and it is possible to control the voltage which is applied to the piezoelectric element 60 with high precision. In addition, the power source generating section of the gate driver 520 is able to be mounted in the integrated circuit apparatus 500 since the power source generating section of the gate driver 520 is reduced in size by being configured using a charge pump circuit, and it is possible to significantly reduce the overall circuitry area of the drive circuit 50 compared to a case where the power source generating section of the gate driver 520 is configured outside of the integrated circuit apparatus 500.

Here, it is understood that frequency components of 50 kHz or more are included when frequency spectrum analysis is carried out on the waveforms of the driving signals for the liquid discharge apparatus 1 to discharge, for example, small dots. In order to generate driving signals which include frequency components of 50 kHz or more in this manner, it is necessary for the frequency of self-excited oscillation (the frequency of the modulation signal Ms) to be 1 MHz or more. If the frequency of self-excited oscillation is less than 1 MHz, the edges of the waveforms of the driving signals which reappear are blunted and rounded off. In other words, the corners are removed and the waveforms are blunted. When the waveforms of the driving signals are blunted, displacement of the piezoelectric elements 60, which are operated according to the rising of the waveforms and the rising edges, becomes sluggish and the quality of the printing deteriorates due to generation of tailing when discharging, discharge faults, and the like. On the other hand, since, if the frequency of self-excited oscillation is higher than 8 MHz, the resolution of the waveforms of the driving signals increases but the switching frequency in the transistors increases, there is an increase in switching loss, and power savings and low heat generation which are priorities deteriorate compared to linear amplification such as with class AB amplifiers. For this reason, it is preferable that the frequency of self-excited oscillation is equal to or more than 1 MHz and equal to or less than 8 MHz.

1-7 Configuration of Head Unit

Since the drive circuits 50-*a* and 50-*b* are configured using the integrated circuit apparatus 500, the transistors (the first transistor M1 and the second transistor M2), the inductor L1, a capacitive element C1, and other electronic components, there are cases where the drive circuits 50-*a* and 50-*b* are considerably heavy in comparison to the selection control section 210 and the selection sections 230 and the weight of the drive circuits 50-*a* and 50-*b* is too large to ignore with regard to the weight of the head 20. For this reason, in the present embodiment where the drive circuits 50-*a* and 50-*b* are mounted on the head unit 2, the position of the center of gravity of the head unit 2 changes depending on the position where the drive circuits 50-*a* and 50-*b* are mounted. Since images are formed by the head unit 2 with the head 20 which is mounted on the carriage 24 discharging ink onto the printing medium P while the carriage 24 is moving in the main scanning direction along the carriage guide shaft 32, it is easy for discharge stability to be reduced and image quality to deteriorate due to greater shaking (rattling) when the carriage 24 is moved as the position of the center of gravity of the head unit 2 is further from the carriage guide shaft 32. Therefore, a special design is adopted in the present embodiment for the position where the drive circuits 50-*a* and 50-*b* are mounted in order to improve the discharge stability of the head unit 2.

Figure 15:
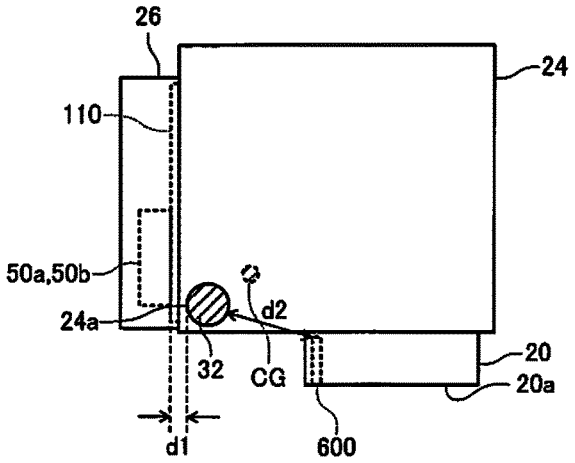
FIG. 15 is a side surface diagram of the head unit of the liquid discharge apparatus as in a first embodiment viewed from a main scanning direction.
Figure 16:
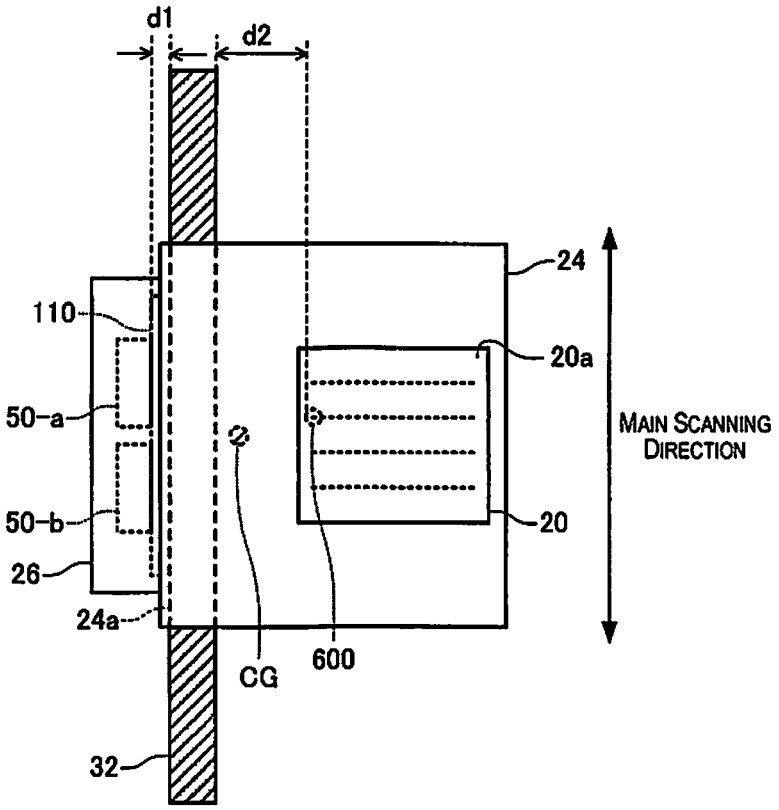
FIG. 16 is a planar diagram of the head unit of the liquid discharge apparatus as in the first embodiment viewed from the discharge surface side of the head.

FIG. 15 and FIG. 16 are diagrams illustrating the configuration of the head unit 2 in the present embodiment. FIG. 15 is a side surface diagram of the head unit 2 viewed from the main scanning direction, and FIG. 16 is a planar diagram of the head unit 2 viewed from a discharge surface 20*a* side (the printing medium P side) of the head 20. Here, illustration of the connection opening for the flexible cable 190 is omitted in FIG. 15 and FIG. 16.

As shown in FIG. 15 and FIG. 16, the carriage 24 in the head unit 2 is mounted with the head 20 and the drive circuits 50-*a* and 50-*b*. The drive circuits 50-*a* and 50-*b* (the integrated circuit apparatus 500, the transistors (the first transistor M1 and the second transistor M2), and other electronic components) are installed on a circuit substrate 110 and are contained in a case 26. Although omitted from the diagrams, the selection control section 210 and the plurality of selection sections 230 are also installed on the circuit substrate 110.

A through hole 24*a* through which the carriage guide shaft 32 passes is provided in the carriage 24. The carriage guide shaft 32 fits into the through hole 24*a* and functions as a carriage support section which supports the carriage 24. In addition, the through hole 24*a* functions as a connection section which connects with the carriage support section.

The head 20 is mounted on the lower side (the side which opposes the printing medium P) of the carriage 24. Then, in the present embodiment, the case 26 is provided so that the drive circuit 50-*a* and 50-*b* are closer to the carriage guide shaft 32 than each of the discharge sections 600 in the head 20. That is, a shortest distance d1 between the carriage guide shaft 32 and the drive circuits 50-*a* and 50-*b* is shorter than a shortest distance d2 between the carriage guide shaft 32 and the discharge section 600 which is closest to the carriage guide shaft 32 as shown in FIG. 15 and FIG. 16. The shortest distance between the through hole 24*a* and the drive circuits 50-*a* and 50-*b* can also be said to be shorter than the shortest distance between the through hole 24*a* and the discharge section 600 which is closest to the through hole 24*a*. In addition, it is typical for the shortest distance between the carriage guide shaft 32 and the drive circuits 50-*a* and 50-*b* to be shorter than the shortest distance between the carriage guide shaft 32 and the head 20 or for the shortest distance between the through hole 24*a* and the drive circuits 50-*a* and 50-*b* to be shorter than the shortest distance between the through hole 24*a* and the head 20.

In order for this positional relationship between the carriage guide shaft 32, the drive circuits 50-*a* and 50-*b*, and the head 20 to be satisfied, the case 26 is mounted on the carriage 24 in the present embodiment so that the carriage guide shaft 32 is positioned between the drive circuits 50-*a* and 50-*b* and the head 20 closer to the drive circuits 50-*a* and 50-*b* in a planar view viewed from the discharge surface 20*a* side of the head 20 as shown in FIG. 16. Then, by arranging the case 26 which contains the drive circuits 50-*a* and 50-*b* in this manner, a center of gravity CG of the head unit 2 is positioned between the drive circuits 50-*a* and 50-*b* and the head 20 and is positioned relatively close to the carriage guide shaft 32 as shown, for example, in FIG. 15 and FIG. 16. Accordingly, according to the liquid discharge apparatus 1 and the head unit 2 as in the first embodiment, it is possible to increase printing quality due to the discharge stability being improved by reducing shaking (rattling) when the carriage 24 is moved.

2. Second Embodiment

The liquid discharge apparatus 1 as in a second embodiment has a configuration in the same manner as the liquid discharge apparatus 1 as in the first embodiment, but the configuration of the head unit 2 is different. Below, the description which overlaps with the first embodiment is omitted or simplified and mainly the content which is different to the first embodiment will be described.

Figure 17:
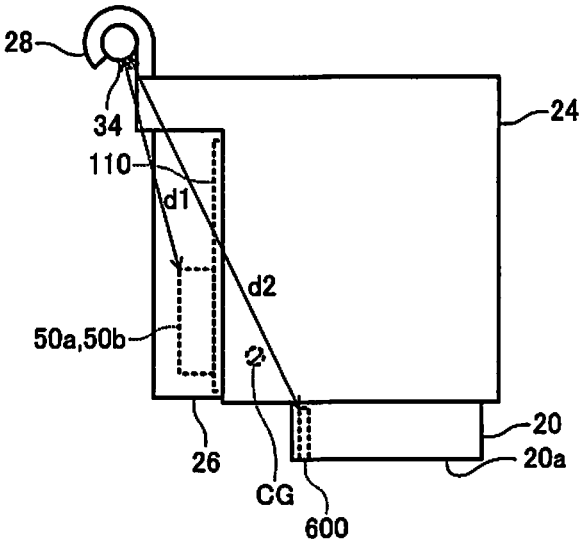
FIG. 17 is a side surface diagram of a head unit of a liquid discharge apparatus as in a second embodiment viewed from a main scanning direction.
Figure 18:
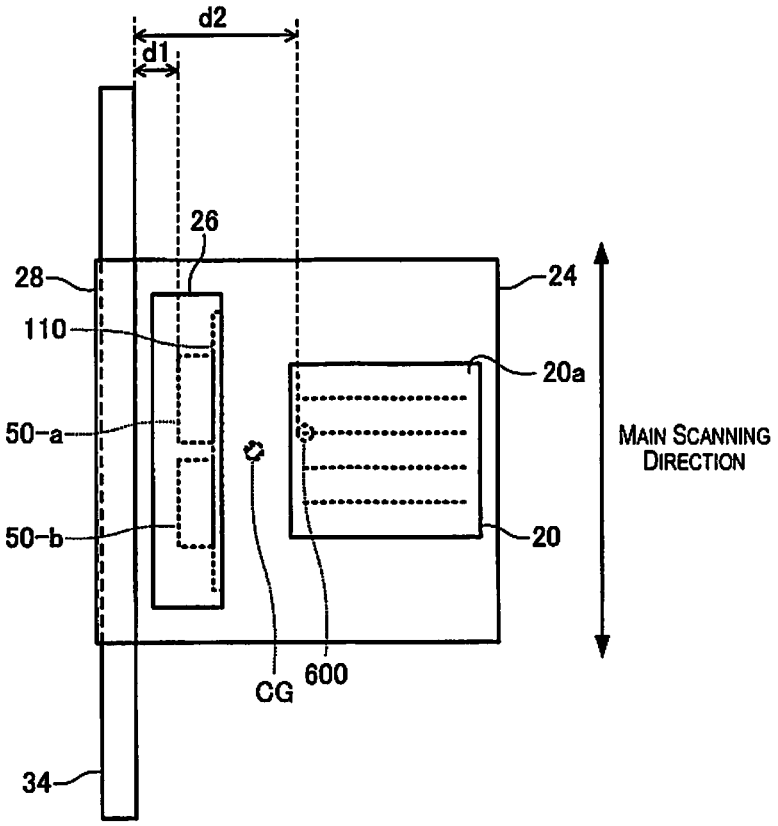
FIG. 18 is a planar diagram of the head unit of the liquid discharge apparatus as in the second embodiment viewed from the discharge surface side of the head.

FIG. 17 and FIG. 18 are diagrams illustrating the configuration of the head unit 2 in the second embodiment. FIG. 17 is a side surface diagram of the head unit 2 viewed from the main scanning direction, and FIG. 18 is a planar diagram of the head unit 2 viewed from the discharge surface 20*a* side (the printing medium P side) of the head 20. Here, illustration of the connection opening for the flexible cable 190 is omitted in FIG. 17 and FIG. 18.

In the second embodiment, the carriage 24 is provided with a hook 28 where the front tip section is curved and the carriage 24 is moved due to being supported by the carriage guide shaft 32 in a state where the front tip end of the hook 28 is inserted into a portion of the carriage guide shaft 32 as shown in FIG. 17 and FIG. 18. The carriage guide shaft 32 functions as a carriage support section which supports the carriage 24 and the hook 28 functions as the connection section which connects with the carriage support section.

In the same manner as the first embodiment, the head 20 is mounted on the lower side (the side which opposes the printing medium P) of the carriage 24 in the second embodiment. Then, in the second embodiment, the case 26 is provided so that the drive circuit 50-*a* and 50-*b* are closer to the carriage guide shaft 32 than each of the discharge sections 600 in the head 20. That is, also in the second embodiment, the shortest distance d1 between the carriage guide shaft 32 and the drive circuits 50-*a* and 50-*b* is shorter than the shortest distance d2 between the carriage guide shaft 32 and the discharge section 600 which is closest to the carriage guide shaft 32 as shown in FIG. 17 and FIG. 18. The shortest distance between the hook 28 and the drive circuits 50-*a* and 50-*b* can also be said to be shorter than the shortest distance between the hook 28 and the discharge section 600 which is closest to the hook 28. In addition, it is typical for the shortest distance between the carriage guide shaft 32 and the drive circuits 50-*a* and 50-*b* to be shorter than the shortest distance between the carriage guide shaft 32 and the head 20 or for the shortest distance between the hook 28 and the drive circuits 50-*a* and 50-*b* to be shorter than the shortest distance between the hook 28 and the head 20.

In order for this positional relationship between the carriage guide shaft 32, the drive circuits 50-*a* and 50-*b*, and the head 20 to be satisfied, the case 26 is mounted on the carriage 24 in the second embodiment so that the case 26 is positioned between the carriage guide shaft 32 and the drive circuits 50-*a* and 50-*b* in a planar view viewed from the discharge surface 20*a* side of the head 20 as shown in FIG. 18. Then, by arranging the case 26 which contains the drive circuits 50-*a* and 50-*b* in this manner, the center of gravity CG of the head unit 2 is positioned between the drive circuits 50-*a* and 50-*b* and the head 20 and is positioned relative close to the carriage guide shaft 32 as shown, for example, in FIG. 17 and FIG. 18. Accordingly, according to the liquid discharge apparatus 1 and the head unit 2 as in the second embodiment, it is possible to increase printing quality due to the discharge stability being improved by reducing shaking of the carriage 24 in the same manner as the liquid discharge apparatus 1 and the head unit 2 as in the first embodiment.

3. Third Embodiment

The liquid discharge apparatus 1 as in a third embodiment has a configuration in the same manner as the liquid discharge apparatus 1 as in the first embodiment and the second embodiment, and has the characteristic in that supply openings 661 are further provided. Below, the description which overlaps with the first embodiment and the second embodiment is omitted or simplified and mainly the content which is different to the first embodiment and the second embodiment will be described.

Figure 19:
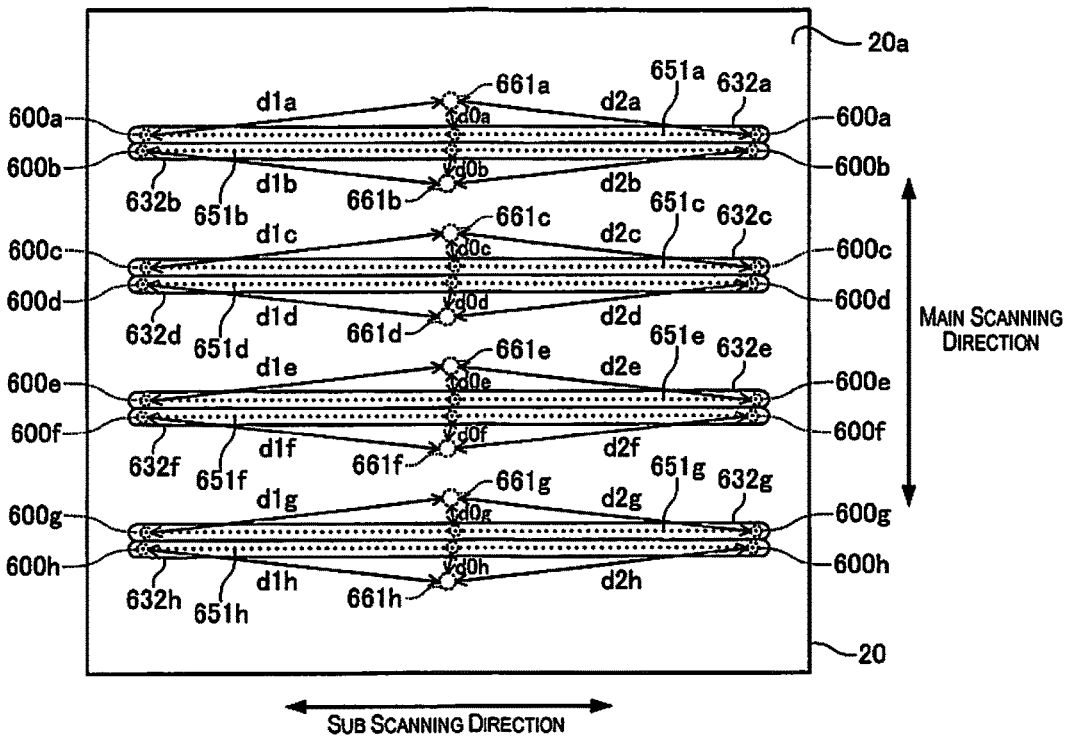
FIG. 19 is a planar diagram of a head unit of a liquid discharge apparatus as in a third embodiment viewed from the discharge surface side of the head.

FIG. 19 is a planar diagram of the head 20 in a third embodiment viewed from the discharge surface 20*a* side (the printing medium P side). Nozzle plates 632*a* to 632*h* are provided in the discharge surface 20*a* of the head 20 as shown in FIG. 19.

A plurality of nozzles 651*a* are arranged in the nozzle plate 632*a* in one row in the sub scanning direction, and the head unit 2 is provided with a discharge section row where a plurality of discharge sections 600*a* which each have the nozzles 651*a* are arranged in one row in the sub scanning direction. In the same manner, a plurality of nozzles 651*b* to 651*h* are respectively provided in the nozzle plates 632*b* to 632*h* in one row in the sub scanning direction, and the head unit 2 is provided with a plurality of discharge section rows where the plurality of discharge sections 600*a* to 600*h* are arranged in one row in the sub scanning direction.

In addition, the head 20 is provided with a supply opening 661*a* for supplying ink (liquid) to the plurality of discharge sections 600*a*. In the same manner, the head 20 is provided with a plurality of supply openings 661*b* to 661*h* for respectively supplying ink (liquid) to the plurality of discharge sections 600*b* to 600*h*.

Then, in the present embodiment, a distance d0*a* between the supply opening 661*a* and the discharge section 600*a* which is in the center of the discharge group row which is formed from the discharge sections 600*a* is shorter than distances d1*a* and d2*a* between the supply opening 661*a* and each of the two discharge sections 600*a* which are at both ends of the discharge group row. In the same manner, a distance d0*b* between the supply opening 661*b* and the discharge section 600*b* which is in the center of the discharge group row is shorter than distances d1*b* and d2*b* between the supply opening 661*b* and each of the two discharge sections 600*b* which are at both ends of the discharge group row. In the same manner, a distance d0*c* between the supply opening 661*c* and the discharge section 600*c* which is in the center of the discharge group row is shorter than distances d1*c* and d2*c* between the supply opening 661*b* and each of the two discharge sections 600*c* which are at both ends of the discharge group row. In the same manner, a distance d0*d* between the supply opening 661*d* and the discharge section 600*d* which is in the center of the discharge group row is shorter than distances d1*d* and d2*d* between the supply opening 661*d* and each of the two discharge sections 600*d* which are at both ends of the discharge group row. In the same manner, a distance d0*e* between the supply opening 661*e* and the discharge section

600*e* which is in the center of the discharge group row is shorter than distances d1*e* and d2*e* between the supply opening 661*e* and each of the two discharge sections 600*e* which are at both ends of the discharge group row. In the same manner, a distance d0*f* between the supply opening 661*f* and the discharge section 600*f* which is in the center of the discharge group row is shorter than distances d if and d2*f* between the supply opening 661*f* and each of the two discharge sections 600*f* which are at both ends of the discharge group row. In the same manner, a distance d0*g* between the supply opening 661*g* and the discharge section 600*g* which is in the center of the discharge group row is shorter than distances d1*g* and d2*g* between the supply opening 661*g* and each of the two discharge sections 600*g* which are at both ends of the discharge group row.

In other words, the supply opening 661*a* is provided at a position which is closer to the center portion of the reservoir 641 which communicates with the cavity 631 for each of the plurality of discharge sections 600*a*. In the same manner, the supply opening 661*b* is provided at a position which is closer to the center portion of the reservoir 641 which communicates with the cavity 631 for each of the plurality of discharge sections 600*b*. In the same manner, the supply opening 661*c* is provided at a position which is closer to the center portion of the reservoir 641 which communicates with the cavity 631 for each of the plurality of discharge sections 600*c*. In the same manner, the supply opening 661*d* is provided at a position which is closer to the center portion of the reservoir 641 which communicates with the cavity 631 for each of the plurality of discharge sections 600*d*. In the same manner, the supply opening 661*e* is provided at a position which is closer to the center portion of the reservoir 641 which communicates with the cavity 631 for each of the plurality of discharge sections 600*e*. In the same manner, the supply opening 661*f* is provided at a position which is closer to the center portion of the reservoir 641 which communicates with the cavity 631 for each of the plurality of discharge sections 600*f*. In the same manner, the supply opening 661*g* is provided at a position which is closer to the center portion of the reservoir 641 which communicates with the cavity 631 for each of the plurality of discharge sections 600*g*. In the same manner, the supply opening 661*h* is provided at a position which is closer to the center portion of the reservoir 641 which communicates with the cavity 631 for each of the plurality of discharge sections 600*h*.

Here, in a case where the supply opening 661*a* were to be provided at a position which are considerably removed from the center portion of the reservoir 641, a period of time would be needed to supply ink due the distance from the supply opening 661*a* to the discharge sections 600*a* which are at both ends being longer and the resistance in the flow path increasing. Accordingly, a situation where the amount of ink in the plurality of supply openings 661*a* which is discharged from the nozzles 651*a* becomes larger than the amount of ink which is supplied from the supply opening 661*a*, and there is a concern that discharge faults due to insufficient supply of ink will be generated.

In contrast to this, since it is possible to shorten the distance from the supply openings 661*a* to the discharge sections 600*a* which are at both ends due to the supply openings 661*a* being provided at positions which are close to the center portion of the reservoir 641 in the liquid discharge apparatus 1 and the head unit 2 as in the third embodiment, it is difficult for discharge faults due to insufficient supply of ink to be generated.

Furthermore, in order to more reliably suppress discharge faults due to insufficient supply of ink to be generated, it is preferable for the distance d1*a* between the supply opening 661*a* and the discharge section 600*a* which is at one end of the discharge section row and the distance d2*a* between the supply opening 661*a* and the discharge section 600*a* which is at the other end of the discharge section row to be substantially the same. In other words, the distance d1*a* and the distance d2*a* being substantially the same is not limited to a case where the distance d1*a* and the distance d2*a* are exactly the same and permits the distance d1*a* and the distance d2*a* to be different to an extent to which discharge faults due to insufficient supply of ink are not generated. In addition, according to this, it is possible to further simplify the structure of the head 20 due to resistance being smaller in the flow path from the supply opening 661*a* to the discharge sections 600*a* which are at both ends and it not being a problem if the pressure for supplying the ink from the supply opening 661*a* is low.

In this manner, according to the liquid discharge apparatus 1 and the head unit 2 as in the third embodiment, it is possible to increase printing quality due to it being difficult for discharge faults due to an insufficient supply of ink to be generated as well as achieving the same effects as the first embodiment and the second embodiment.

4. Fourth Embodiment

The liquid discharge apparatus 1 as in a fourth embodiment is different to the liquid discharge apparatus 1 as in the first embodiment, the second embodiment, and the third embodiment which are provided with the drive circuits 50-*a* and 50-*b* which generate the driving signals COM-A and COM-B using a class D amplifier and is provided with a drive circuit which generates driving signals for driving the discharge sections 600 by utilizing regeneration through a capacitor or a secondary battery. The other configurations of the liquid discharge apparatus 1 as in the fourth embodiment may be the same as the liquid discharge apparatus 1 as in the first embodiment, the second embodiment, and the third embodiment. Below, the description which overlaps with the first embodiment, the second embodiment, and the third embodiment is omitted or simplified and mainly the content which is different to the first embodiment, the second embodiment, and the third embodiment will be described.

4.1 Electrical Configuration of Liquid Discharge Apparatus

Figure 20:
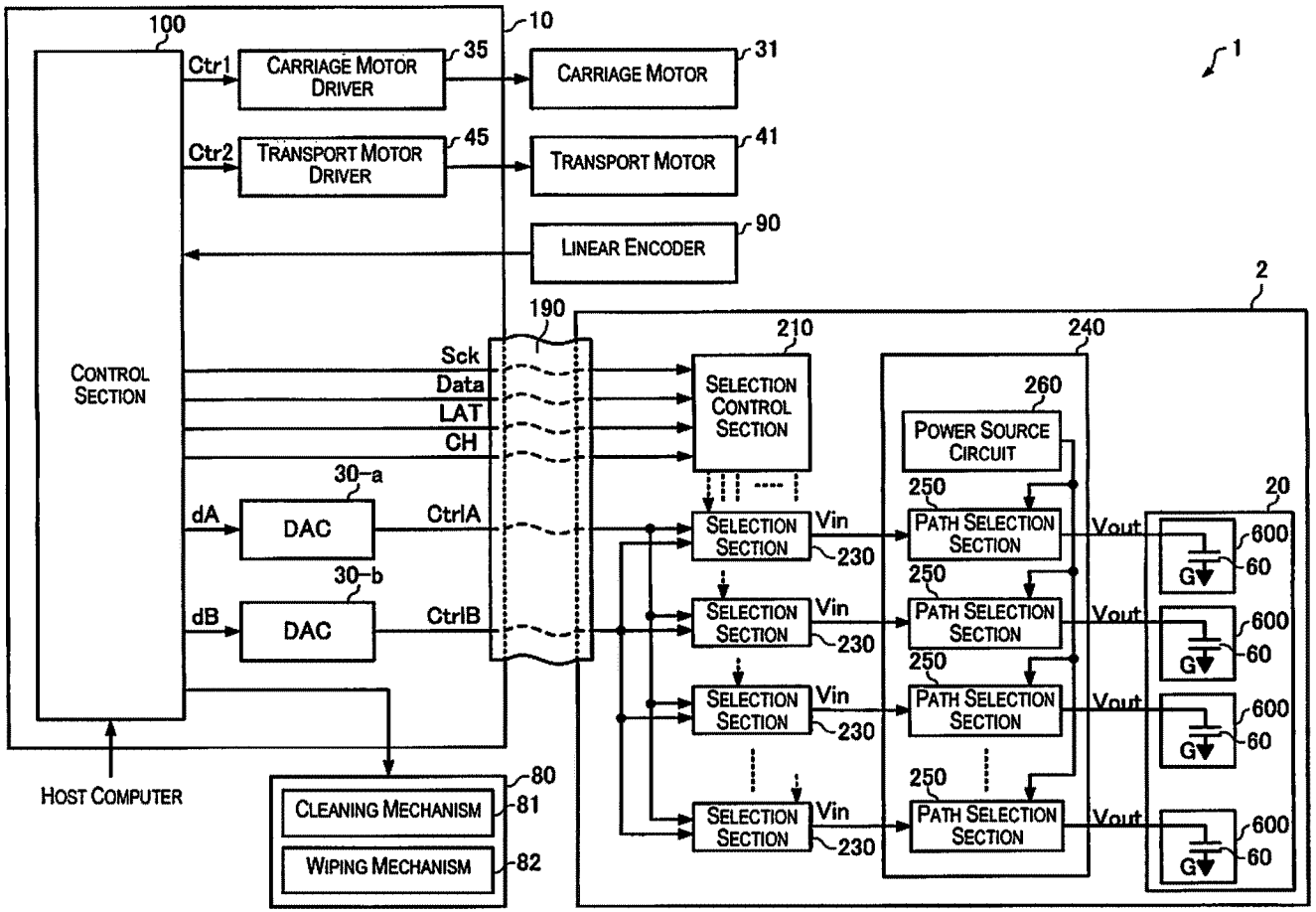
FIG. 20 is a block diagram illustrating an electrical configuration of a liquid discharge apparatus as in a fourth embodiment.

FIG. 20 is a diagram illustrating an electrical configuration of the liquid discharge apparatus 1 as in the fourth embodiment. The same reference numerals are given in FIG. 20 to the same constituent elements as in FIG. 4, and the description of the same constituent elements as in FIG. 4 will be omitted or simplified.

In the present embodiment, the control unit 10 includes the control section 100, the carriage motor driver 35, the transport motor driver 45, and digital to analog converters (DACs) 30-*a* and 30*b* as shown in FIG. 20. The functions of the carriage motor driver 35 and the transport motor driver 45 are the same as the first embodiment, the second embodiment, and the third embodiment.

The control section 100 outputs various types of control signals and the like for controlling each section when image data is supplied from a host computer. In particular, the control section 100 supplies the digital data dA and dB to the DACs 30-*a* and 30-*b* in the present embodiment.

The DAC 30-*a* converts the data dA to an analog control signal CtrlA and supplies the control signal CtrlA to the head unit 2. In the same manner, the DAC 30-*b* converts the data dB to an analog control signal CtrlB and supplies the control signal CtrlB to the head unit 2.

The waveform for the control signal CtrlA is, for example, a waveform which is similar to the waveform of the driving signal COM-A in FIG. 8 and is a waveform where the trapezoidal waveform Adp1, which is arranged over the time period T1 from when the control signal LAT is output (rises up) to when the control signal CH is output in the printing cycle Ta, and a trapezoidal waveform Adp2, which is arranged over a time period T2 from when the control signal CH is output to when the next control signal LAT is output in the printing cycle Ta, are continuous. In the same manner, the waveform for the control signal CtrlB is, for example, a waveform which is similar to the waveform of the driving signal COM-B in FIG. 8 and is a waveform where the trapezoidal waveform Bdp1 which is arranged over the time period T1 and the trapezoidal waveform Bdp2 which is arranged over a time period T2 are continuous.

The head unit 2 has the drive circuits 50-*a* and 50-*b*, the selection control section 210, the plurality of selection sections 230, a drive circuit 240, and the head 20.

In accordance with the instructions from the selection control section 210, the control section 230 selects (or does not select) and supplies either of the control signal CtrlA or CtrlB which is supplied from the control unit 10 via the flexible cable 190 as a control signal Vin with regard to each path selection section 250 in the drive circuit 240. The circuit configuration of the selection control section 210 may be the same as in FIG. 9. In addition, the circuit configuration of the selection sections 230 may be the same as in FIG. 11.

The path selection sections 250 generate driving signals for driving the piezoelectric elements 60 in accordance with the control signal Vin which is supplied from the selection sections 230 using a plurality of voltages which are supplied from a power source circuit 260 and power source voltages $V_H$ and G. The voltage of the driving signals has the notation of Vout in FIG. 20. Here, the power source voltage G has a ground potential and is a reference with a voltage of zero unless there is description otherwise. In addition, the power source voltage $V_H$ has a high voltage with regard to the power source voltage G (ground potential) in the present embodiment. The power source voltages $V_H$ and G may be supplied from the control unit 10 via the flexible cable 190 or may be generated in the head unit 2.

One ends of the piezoelectric elements 60 are connected to the output end of the corresponding path selection sections 250 and the other ends of the piezoelectric elements 60 are connected in common to the ground.

The detailed configuration of the power source circuit 260 will be described in detail later, but the power source circuit 260 generates voltages $0V_H/6$, $1V_H/6$, $2V_H/6$, $3V_H/6$, $4V_H/6$, and $5V_H/6$ by dividing and redistributing the power source voltages $V_H$ and G using a charge pump circuit and supplies these voltages in common across the plurality of path selection sections 250.

The power source circuit 260 generates the voltages $0V_H/6$, $1V_H/6$, $2V_H/6$, $3V_H/6$, $4V_H/6$, and $5V_H/6$ from the power source voltages $V_H$ and G and supplies these voltages to the path selection sections 250, and the path selection sections 250 supply the voltages Vout which tracks the voltage of the control signal Vin to the piezoelectric elements 60 using these voltages. Here, the voltage $0V_H/6$ is supplied from the power source circuit 260 to the path selection sections 250 via power source wiring 410, and the voltages $1V_H/6$, $2V_H/6$, $3V_H/6$, $4V_H/6$, and $5V_H/6$ are supplied via power source wirings 411, 412, 413, 414, and 415 in the same manner (refer to FIG. 21).

Figure 22:
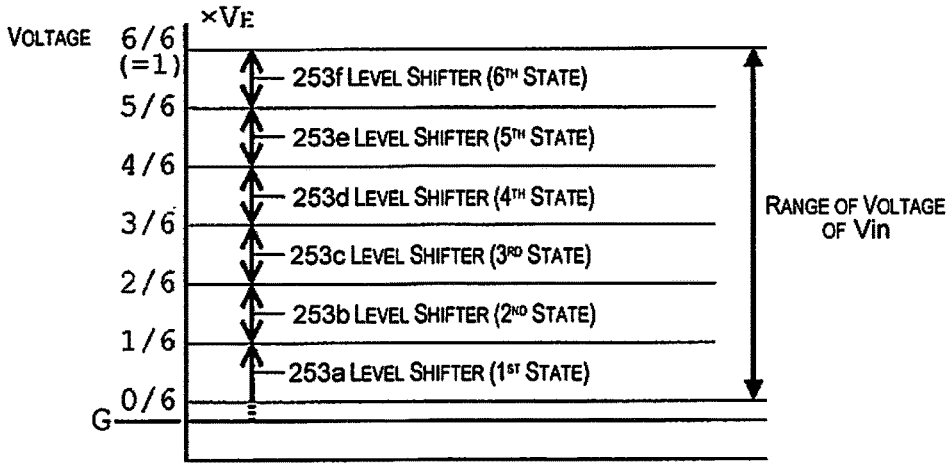
FIG. 22 is a diagram illustrating the range of operations and the like for each level shifter in the path selection section.

The relative magnitudes of the voltages is $0V_H/6<1V_H/6<2V_H/6<3V_H/6<4V_H/6<5V_H/6$ as shown in FIG. 22.

It is necessary to note that the notation of these voltages does not have a meaning such that, for example, the voltage $0V_H/6$ is zero times the voltage $V_H$ or a meaning such that the voltage $1V_H/6$ is one sixth of the voltage $V_H$. As will be described in detail later, when the value of $0V_H/6$ is a significant value in the present embodiment, between the significant voltage and the voltage $V_H$ is divided into six and have the notation of $0V_H/6$, $1V_H/6$, $2V_H/6$, $3V_H/6$, $4V_H/6$, and $5V_H/6$ from the low potential side. In addition, the voltage $0V_H/6$ is set as a voltage where the voltage which is divided into six is further divided by three and is a voltage as viewed from the ground in the present embodiment. Accordingly, when the power source voltage G (ground potential) is set to a voltage of zero, the voltage $0V_H/6$ is $1/19$ of the voltage $V_H$, the voltage $1V_H/6$ is $4/19$ of the voltage $V_H$, the voltage $2V_H/6$ is $7/19$ of the voltage $V_H$, the voltage $3V_H/6$ is $10/19$ of the voltage $V_H$, the voltage $4V_H/6$ is $13/19$ of the voltage $V_H$, and the voltage $5V_H/6$ is $16/19$ of the voltage $V_H$ in a stricter sense as will be described later.

Here, in order to prioritize ease of understanding, the voltages which are supplied from the power source circuit 260 have the notation of $0V_H/6$, $1V_H/6$, $2V_H/6$, $3V_H/6$, $4V_H/6$, and $5V_H/6$ in terms of the relationship of being divided by six for the path selection sections 250.

4-2. Configuration of Path Selection Section

Figure 21:
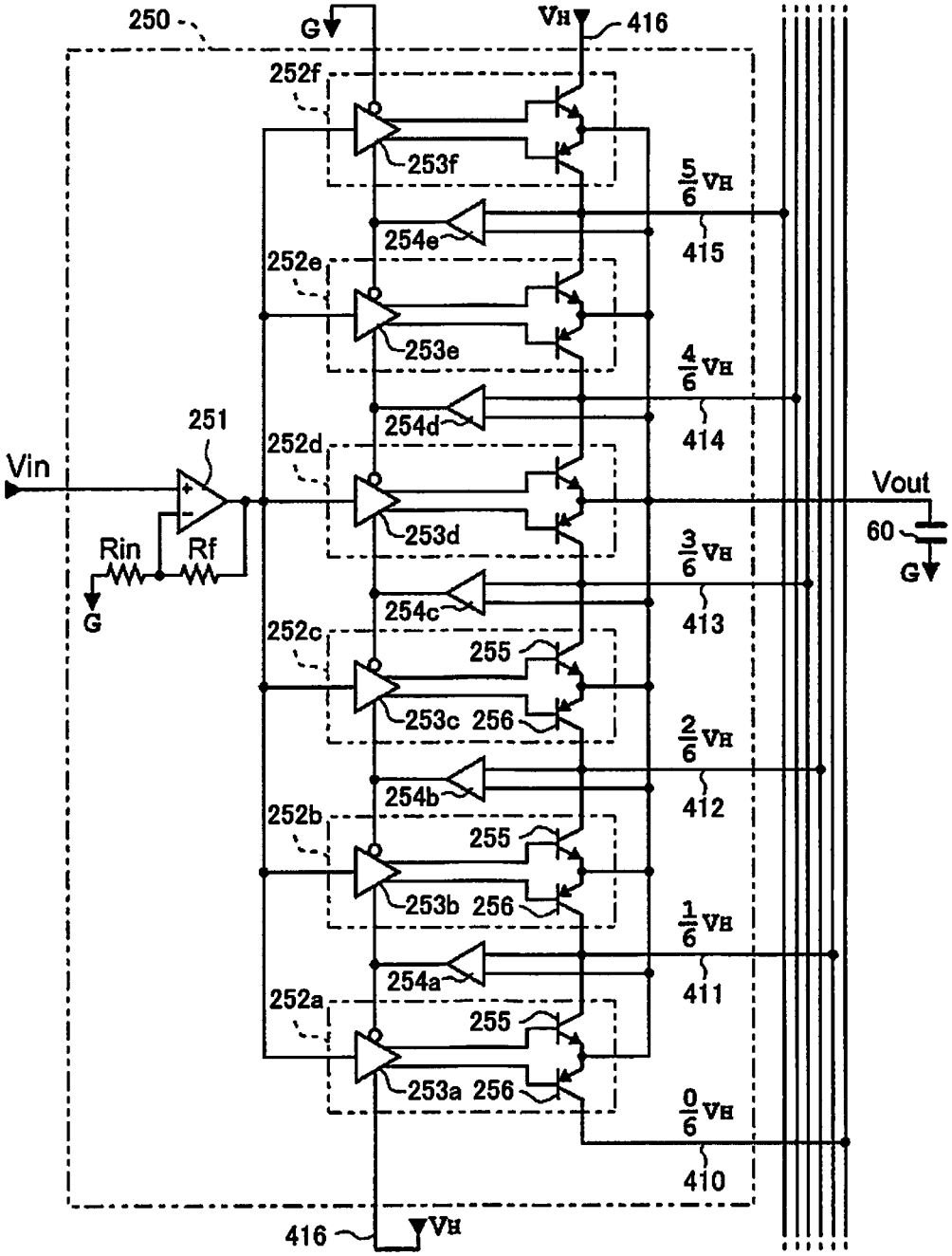
FIG. 21 is a diagram illustrating one example of the configuration of a path selection section in the drive circuit.

FIG. 21 is a diagram illustrating one example of the configuration of the path selection section 250 which drives one of the piezoelectric elements 60. As shown in FIG. 21, the path selection section 250 includes an operational amplifier 251, unit circuits 252*a* to 252*f*, and comparators 254*a* to 254*e* and is configured so that the piezoelectric element 60 is driven in accordance with the control signal Vin.

The path selection section 250 uses six types of voltages excluding the power source voltages $V_H$ and G, in detail, the voltages $0V_H/6$, $1V_H/6$, $2V_H/6$, $3V_H/6$, $4V_H/6$, and $5V_H/6$ in order from the lowest. The six types of voltages are supplied from the power source circuit 260 respectively via the power source wirings 410 to 415.

The control signal Vin which is selected by the selection section 230 is supplied to the input end (+) of the operational amplifier 251 which is at the input end of the path selection section 250. The output signal of the operational amplifier 251 is supplied to each of the unit circuits 252*a* to 252*f*, and is negatively fed back to the input end (−) of the operational amplifier 251 via a resistor Rf and is connected to the ground via a resistor Rin. For this reason, the operational amplifier 251 carries out non-inversion amplification of the control signal Vin by (1+Rf/Rin) times.

It is possible to set the voltage amplification rate of the operational amplifier 251 using the resistors Rf and Rin, and for convenience, Rf is set below to zero and Rin is set to infinity. That is, there is description below where the voltage amplification rate of the operational amplifier 251 is set to "1" and the control signal Vin is supplied to the unit circuits 252*a* to 252*f* without any changes. Here, the voltage amplification rate may be a value other than "1".

The unit circuits 252*a* to 252*f* are provided in order from the lowest voltage with regard to two voltages which are adjacent to each other out of the seven types of voltages where the power source voltage $V_H$ is added to the six types of voltages described above. In detail, the unit circuit 252*a* is provided to correspond to the voltage $0V_H/6$ and the voltage $1V_H/6$, the unit circuit 252*b* is provided to correspond to the voltage $1V_H/6$ and the voltage $2V_H/6$, the unit circuit 252*c* is provided to correspond to the voltage $2V_H/6$ and the voltage $3V_H/6$, the unit circuit 252*d* is provided to correspond to the voltage $3V_H/6$ and the voltage $4V_H/6$, the unit circuit 252*e* is provided to correspond to the voltage $4V_H/6$ and the voltage $5V_H/6$, and the unit circuit 252*f* is provided to correspond to the voltage $5V_H/6$ and the voltage $V_H$.

The circuit configurations of the unit circuits 252*a* to 252*f* are the same as each other and include the correspond level shifter out of level shifters 253*a* to 253*f* and a NPN transistor 255 and a PNP type transistor 256 which are bipolar types of transistors.

Here, the unit circuits 252*a* to 252*f* will be described simply with the reference numeral "252" when describing a typical and not specific unit circuit, and the level shifters 253*a* to 253*f* will be described simply with the reference numeral "253" in the same manner when describing a typical and not specific level shifter.

The level shifter 253 takes either state out of an enable state or a disable state. In detail, the level shifter 253 is in the enable state when the signal which is supplied to the negative control end which is marked with a black circle is at the L level and the signal which is supplied to the positive control end which is not marked with a black circle is at the H level and is in the disable state when not in the enable state.

Out of the six types of voltages, five types of voltages excluding the voltage $0V_H/6$ correspond one-to-one with each of the comparators 254*a* to 254*e* as will be described later. Here, when focusing on a certain one of the unit circuits 252, the output signal of the comparator which is associated with the high voltage side out of the two voltages which correspond to the unit circuit 252 is supplied to the negative control end of the level shifter 253 in the unit circuit 252, and the output signal of the comparator which is associated with the low voltage side out of the two voltages which correspond to the unit circuit 252 is supplied to the positive control end of the level shifter 253 in the unit circuit 252. Here, the negative control end of the level shifter 253*f* in the unit circuit 252*f* is connected to the ground with a voltage of zero which is equivalent to the L level, and the positive control end of the level shifter 253*a* in the unit circuit 252*a* is connected to the power source wiring 416 which supplies the voltage $V_H$ which is equivalent to the H level.

In addition, the level shifter 253 in the enable state supplies the input voltage of the control signal Vin to a base terminal in the transistor 255 by shifting in the minus direction by a specific amount and supplies the input voltage of the control signal Vin to a base terminal in the transistor 256 by shifting in the plus direction by a specific amount. The level shifter 253 in the disable state supplies the voltage when the transistor 255 is turned off irrespective of the control signal Vin, that is, the voltage $V_H$ to the base terminal in the transistor 255 and supplies the voltage when the transistor 256 is turned off, that is, a voltage of zero to the base terminal in the transistor 256.

Here, the specific value is set at, for example, a voltage (a bypass voltage of approximately 0.6 volts) between the base and the emitter where a current starts to flow to an emitter terminal. For this reason, the specific value has the characteristics of being set according to the properties of the transistors 255 and 256 and is set to zero if the transistors 255 and 256 are ideal.

A collector terminal of the transistor 255 is connected to the power source wiring which supplies the high voltage side out of the two corresponding voltages and a collector terminal of the transistor 256 is connected to the power source wiring 410 which supplies the low voltage side. For example, in the unit circuit 252*a* which corresponds to the voltage $0V_H/6$ and the voltage $1V_H/6$, the collector terminal of the transistor 255 is connected to the power source wiring 411 which supplies the voltage $1V_H/6$ and the collector terminal of the transistor 256 is connected to the power source wiring 410 which supplies the voltage $0V_H/6$. In addition, for example, in the unit circuit 252*b* which corresponds to the voltage $1V_H/6$ and the voltage $2V_H/6$, the collector terminal of the transistor 255 is connected to the power source wiring 412 which supplies the voltage $2V_H/6$ and the collector terminal of the transistor 256 is connected to the power source wiring 411 which supplies the voltage $1V_H/6$. Here, in the unit circuit 252*f* which corresponds to the voltage $5V_H/6$ and the voltage $V_H$, the collector terminal of the transistor 255 is connected to the power source wiring 416 which supplies the voltage $V_H$ and the collector terminal of the transistor 256 is connected to the power source wiring 415 which supplies the voltage $5V_H/6$.

On the other hand, each of the emitter terminals of the transistors 255 and 256 in the unit circuits 252*a* to 252*f* are connected in common to one end of the piezoelectric element 60. Then, the common connection points for each of the emitter terminals of the transistors 255 and 256 are connected to one end of the piezoelectric elements 60 as the output terminal for the path selection section 250.

The comparators 254*a* to 254*e* correspond to the five types of the voltages $1V_H/6$, $2V_H/6$, $3V_H/6$, $4V_H/6$, and $5V_H/6$ described above, compare the relative magnitudes of the voltages which are supplied to the two input ends, and output signals which indicate the comparison results. Here, out of the two input ends in the comparators 254*a* to 254*e*, one end is connected to the power source voltage which supplies a voltage which corresponds to the one end and the other end is connected in common to one end of the piezoelectric element 60 along with each of the emitter terminals of the transistors 255 and 256. For example, the one end out of the two ends of the comparator 254*a* which corresponds to the voltage $1V_H/6$ is connected to the power source wiring 411 which supplies the voltage $1V_H/6$ which corresponds to the one end, and the one end out of the two ends of the comparator 254*b* which corresponds to the voltage $2V_H/6$ is connected to the power source wiring 412 which supplies the voltage $2V_H/6$ which corresponds to the one end.

Each of the comparators 254*a* to 254*e* output a signal which is set to the H level if the voltage Vout at the other end out of the input ends is equal to or higher than the voltage of the one end and outputs a signal which is set at the L level if the voltage Vout is less than the voltage of the one end.

In detail, for example, the comparator 254*a* outputs a signal which is set to the H level if the voltage Vout is equal to or higher than the voltage $1V_H/6$ and outputs a signal which is set at the L level if the voltage Vout is less than the voltage $1V_H/6$. In addition, for example, the comparator 254*b* outputs a signal which is set to the H level if the voltage Vout is equal to or higher than the voltage $2V_H/6$ and outputs a signal which is set at the L level if the voltage Vout is less than the voltage $2V_H/6$.

When focusing on one voltage out of the five types of voltages, the feature where the output signal of the comparator which corresponds to the voltage which is the focus is supplied to the negative control end of the level shifter 253 of the unit circuit where the voltage is the high voltage side and to the positive control end of the level shifter 253 of the unit circuit where the voltage is the low voltage side is as described above.

For example, the output signal of the comparator 254*a* which corresponds to the voltage $1V_H/6$ is supplied to the negative control end of the level shifter 253*a* of the unit circuit 252*a* which is associated with the voltage $1V_H/6$ as the high voltage side and to the positive control end of the level shifter 253*b* of the unit circuit 252*b* which is associated with the voltage $1V_H/6$ as the low voltage side. In addition, for example, the output signal of the comparator 254*b* which corresponds to the voltage $2V_H/6$ is supplied to the negative control end of the level shifter 253*b* of the unit circuit 252*b* which is associated with the voltage $2V_H/6$ as the high voltage side and to the positive control end of the level shifter 253*c* of the unit circuit 252*c* which is associated with the voltage $2V_H/6$ as the low voltage side.

Next, the operations of the path selection section 250 will be described. First, what states are the level shifters 253*a* to 253*f* in with regard to the voltage Vout which is held by the piezoelectric element 60.

FIG. 22 is a diagram illustrating the range of voltages over which the level shifters 253*a* to 253*f* are in the enable state with regard to the voltage Vout.

To begin with, in a first state where the voltage Vout is less than the voltage $1V_H/6$, the output signals of the comparators 254*a* to 254*f* are all at the L level. For this reason, in the first state, only the level shifter 253*a* is in the enable state and the other level shifters 253*b* to 253*f* are in the disable state.

In a second state where the voltage Vout is equal to or more than the voltage $1V_H/6$ and less than the voltage $2V_H/6$, the output signal of the comparator 254*b* is at the H level and the output signals of the other comparators are at the L levels. Accordingly, in the second state, only the level shifter 253*b* is in the enable state and the other level shifters 253*a* and 253*c* to 253*f* are in the disable state.

Although the details beyond this are omitted, only the level shifter 253*c* is in the enable state in a third state where the voltage Vout is equal to or more than the voltage $2V_H/6$ and less than the voltage $3V_H/6$, only the level shifter 253*d* is in the enable state in a fourth state where the voltage Vout is equal to or more than the voltage $3V_H/6$ and less than the voltage $4V_H/6$, only the level shifter 253*e* is in the enable state in a fifth state where the voltage Vout is equal to or more than the voltage $4V_H/6$ and less than the voltage $5V_H/6$, and only the level shifter 253*f* is in the enable state in a sixth state where the voltage Vout is equal to or more than the voltage $5V_H/6$.

Here, the range of voltages which the control voltage Vin (COM-A and COM-B) is able to take is set as equal to or more than the voltage $0V_H/6$ and less than the voltage $V_H$. In addition, the first state to the sixth state are regulated by the voltage Vout. It is possible for this to be reworded as the state of the charge which is held (stored) by the piezoelectric elements 60.

Here, when the level shifter 253*a* is in the enable state in the first state, the level shifter 253*a* supplies a voltage signal where the control signal Vin is level shifted by a certain value in the minus direction to the base terminal of the transistor 255 in the unit circuit 252*a* and supplies a voltage signal where the control signal Vin is level shifted by a certain value in the plus direction to the base terminal of the transistor 256 in the unit circuit 252*a*

Here, when the voltage of the control signal Vin is higher than the voltage Vout (the voltage at the connection point between the emitter terminals), a current according to the difference (the voltage between the base and the emitter, in stricter terms, the voltage where the certain value is subtracted from the voltage between the base and the emitter) flows from the collector terminal to the emitter terminal in the transistor 255. For this reason, when the voltage Vout gradually rises and gets closer to the voltage of the control signal Vin and the voltage Vout comes to eventually match with the voltage of the control signal Vin, the current which flows to the transistor 255 is zero at this point in time.

On the other hand, when the voltage of the control signal Vin is lower than the voltage Vout, a current according to the difference flows from the emitter terminal to the collector terminal in the transistor 256. For this reason, when the voltage Vout gradually falls and gets closer to the voltage of the control signal Vin and the voltage Vout comes to eventually match with the voltage of the control signal Vin, the current which flows to the transistor 256 is zero at this point in time.

Accordingly, the transistors 255 and 256 in the unit circuit 252*a* execute control such that the voltage Vout matches with the control signal Vin in the first state.

Here, since the level shifters 253 in the unit circuits 252*b* to 252*f* other than the unit circuit 252*a* are in the disable state in the first state, the voltage $V_H$ is supplied to the base terminals of the transistors 255 and a voltage of zero is supplied to the base terminals of the transistors 256. For this reason, since the transistors 255 and 256 in the unit circuits 252*b* to 252*f* are turned off in the first state, the unit circuits 252*b* to 252*f* do not contribute to controlling of the voltage Vout.

In addition, here, the first state is described, but the operations in the second state to the sixth state are the same. In detail, there is control so that any of the unit circuits 252*a* to 252*f* become effective depending on the voltage Vout which is held by the piezoelectric element 60 and the transistors 255 and 256 in the unit circuit 252 which become effective match the voltage Vout with the control signal Vin. For this reason, when looking over all of the path selection sections 250, there are operations so that the voltage Vout tracks the voltage of the control signal Vin.

Figure 23:
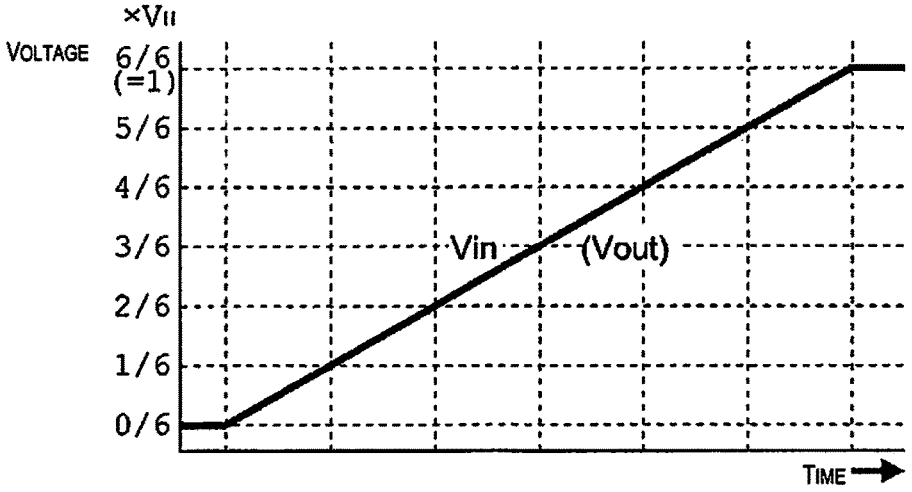
FIG. 23 is a diagram illustrating one example of the relationship between the input and the output of the path selection section.
Figure 24:
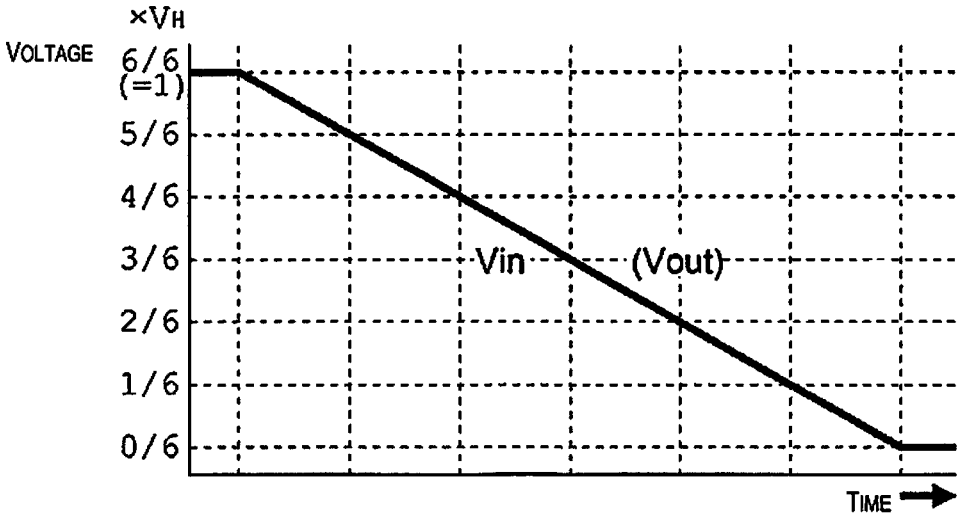
FIG. 24 is a diagram illustrating one example of the relationship between the input and the output of the path selection section.

Accordingly, when the control voltage Vin increases from the voltage $0V_H/6$ to the voltage $V_H$, the voltage Vout tracks the control voltage Vin and changes from the voltage $0V_H/6$ to the voltage $V_H$ as shown in FIG. 23. In addition, when the control voltage Vin falls from the voltage $V_H$ to the voltage $0V_H/6$, the voltage Vout tracks the control voltage Vin and changes from the voltage $V_H$ to the voltage $0V_H/6$ as shown in FIG. 24.

Figure 25:
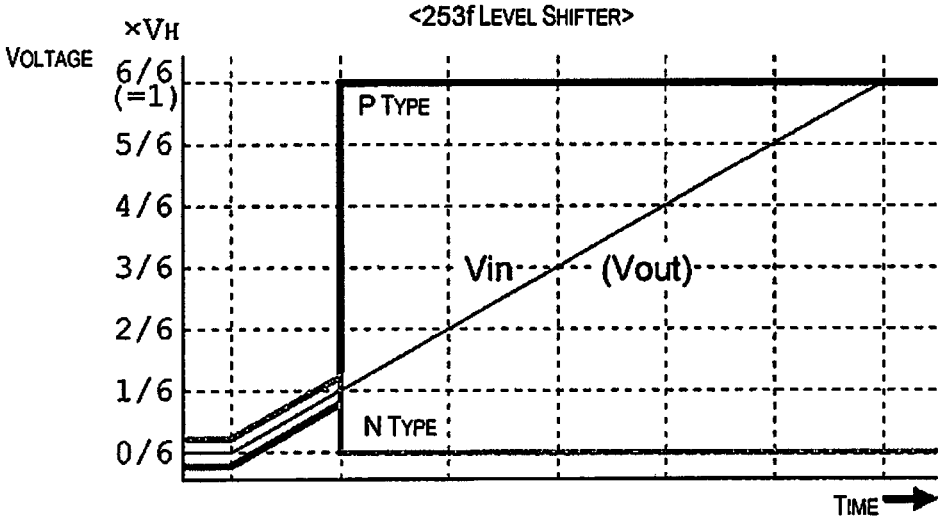
FIG. 25 is a diagram illustrating one example of the relationship between the input and the output of the level shifter.
Figure 26:
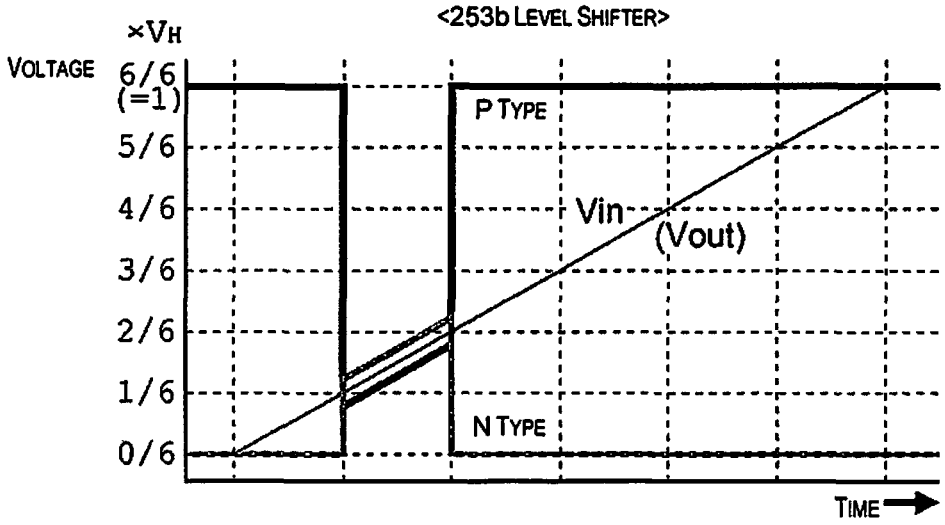
FIG. 26 is a diagram illustrating one example of the relationship between the input and the output of the level shifter.
Figure 27:
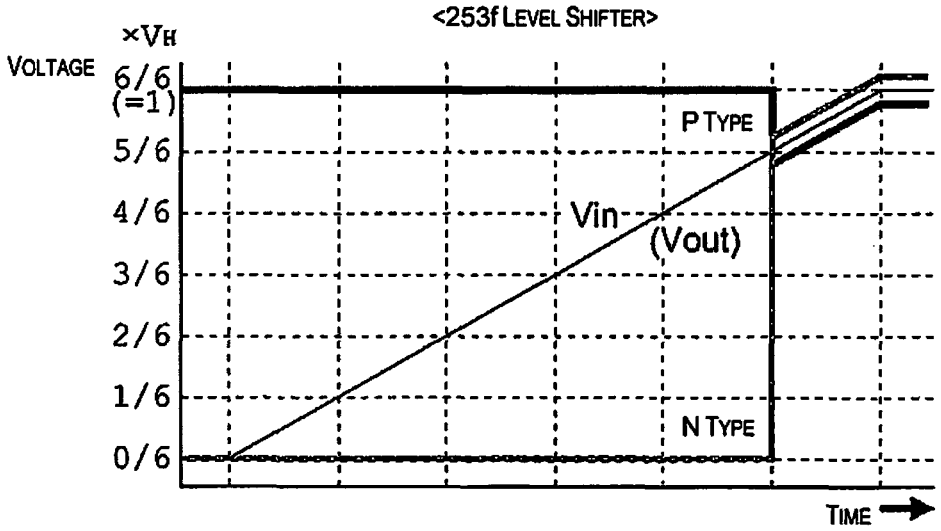
FIG. 27 is a diagram illustrating one example of the relationship between the input and the output of the level shifter.

FIG. 25 to FIG. 27 are diagrams for explaining the operations of the level shifters. When the control voltage Vin changes and increases from the voltage $0V_H/6$ to the voltage $V_H$, the voltage Vout increases to track the control voltage Vin. In the process of increasing, the level shifter 253*a* is in the enable state in the first state where the voltage Vout is less than the voltage $1V_H/6$. For this reason, the voltage (with the notation of "P type") which is supplied to the base terminal of the transistor 255 by the level shifter 253*a* is a voltage where the control signal Vin is shifted by the certain amount in the minus direction, and the voltage (with the notation of "N type") which is supplied to the base terminal of the transistor 256 by the level shifter 253*a* is a voltage where the control signal Vin is shifted by the certain amount in the plus direction as shown in FIG. 25. On the other hand, since the level shifter 253*a* is in the disable state other than when in the first state, the voltage which is supplied to the base terminal of the transistor 255 is $V_H$ and the voltage which is supplied to the base terminal of the transistor 256 is zero.

Here, FIG. 26 illustrates the voltage waveform which is output by the level shifter 253*b* and FIG. 27 illustrates the voltage waveform which is output by the level shifter 253*f*. There is no need for special description if it is noted that the level shifter 253*b* is in the enable state when in the second state where the voltage Vout is equal to or more than the voltage $1V_H/6$ and is less than the voltage $2V_H/6$, and the level shifter 253*f* is in the enable state when in the sixth state where the voltage Vout is equal to or more than the voltage $5V_H/6$ and is less than the voltage $V_H$.

In addition, description of the operations of the level shifter 253*c* to 253*c* in processes where the voltage of the control signal Vin (and the voltage Vout) is increasing and description of the operations of the level shifter 253*a* to 253*f* in processes where the voltage of the control signal Vin (and the voltage Vout) is fall are omitted.

Next, the flow of current (charge) in the unit circuits 252*a* to 252*f* are described by being split into when charging and when discharging with the unit circuits 252*a* and 252*b* as examples.

Figure 28:
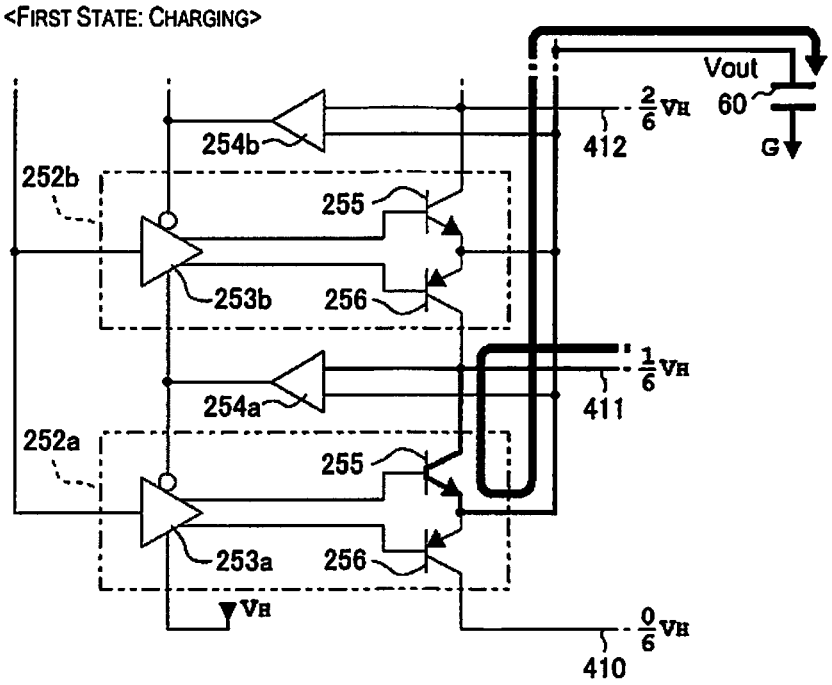
FIG. 28 is a diagram for explaining the flow of current (charge) in the path selection section.

FIG. 28 is a diagram illustrating an operation when the piezoelectric element 60 is being charged when in the first state (the state where the voltage Vout is less than the voltage $1V_H/6$). Since the level shifter 253*a* is in the enable state and the other level shifters 253*b* to 253*f* are in the disable state in the first state, it is sufficient to only focus on the unit circuit 252*a*. When the voltage of the control signal Vin is higher than the voltage Vout in the first state, current flows according to the voltage between the base and the emitter in the transistor 255 of the unit circuit 252*a*. On the other hand, the transistor 256 of the unit circuit 252*a* is turned off.

When charging in the first state, the piezoelectric element 60 is charged with charge due to current flowing in a path of the power source wiring 411→the transistor 255 (of the unit circuit 252*a*)→the piezoelectric element 60 as shown by the arrow in FIG. 28. The voltage Vout rises due to the charging. Charging of the piezoelectric element 60 stops due to the transistor 255 of the unit circuit 252*a* being turned off when the voltage Vout gets closer to the voltage of the control signal Vin and eventually matches with the voltage of the control signal Vin.

On the other hand, since, in a case where the control signal Vin rises so as to be equal to or more than the voltage $1V_H/6$, the voltage Vout tracks the control signal Vin and becomes equal to or more than the voltage $1V_H/6$, there is a shift from the first state to the second state (a state where the voltage Vout is equal to or more than the voltage $1V_H/6$ and less than the voltage $2V_H/6$).

Figure 29:
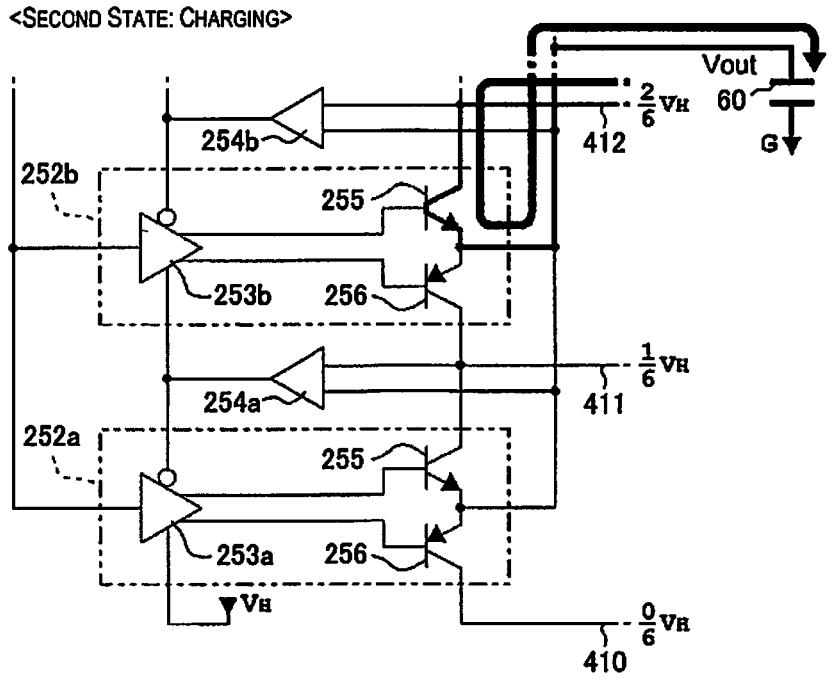
FIG. 29 is a diagram for explaining the flow of current (charge) in the path selection section.

FIG. 29 is a diagram illustrating an operation when the piezoelectric element 60 is being charged when in the second state. Since the level shifter 253*b* is in the enable state and the other level shifters 253*a* and 253*c* to 253*f* are in the disable state in the second state, it is sufficient to only focus on the unit circuit 252*b*. When the control signal Vin is higher than the voltage Vout in the second state, current flows according to the voltage between the base and the emitter in the transistor 255 of the unit circuit 252*b*. On the other hand, the transistor 256 of the unit circuit 252*b* is turned off.

When charging in the second state, the piezoelectric element 60 is charged with charge due to current flowing in a path of the power source wiring 412→the transistor 255 (of the unit circuit 252*b*)→the piezoelectric element 60 as shown by the arrow in FIG. 29. That is, in a case where the piezoelectric element 60 is being charged in the second state, one end of the piezoelectric element 60 is electrically connected with regard to the power source circuit 260 via the power source wiring 412. In this manner, when there is a shift from the first state to the second state when the voltage Vout is rising, the power source origin for current is switched from the power source wiring 411 to the power source wiring 412. Charging of the piezoelectric element 60 stops due to the transistor 255 of the unit circuit 252*b* being turned off when the voltage Vout gets closer to the control signal Vin and eventually matches with the control signal Vin.

On the other hand, as a result of the voltage Vout tracking the control signal Vin and reaching the voltage $2V_H/6$ in a case where the control signal Vin rises to be equal to or more than the voltage $2V_H/6$, there is a shift from the second state to the third state (a state where the voltage Vout is equal to or more than the voltage $2V_H/6$ and less than the voltage $3V_H/6$).

Here, although the charging operations from the third state to the sixth state are not particularly shown in the diagram due to the charging operations being substantially the same, the power source origin for current is switched in order between the power source wirings 413, 414, 415, and 416.

Figure 30:
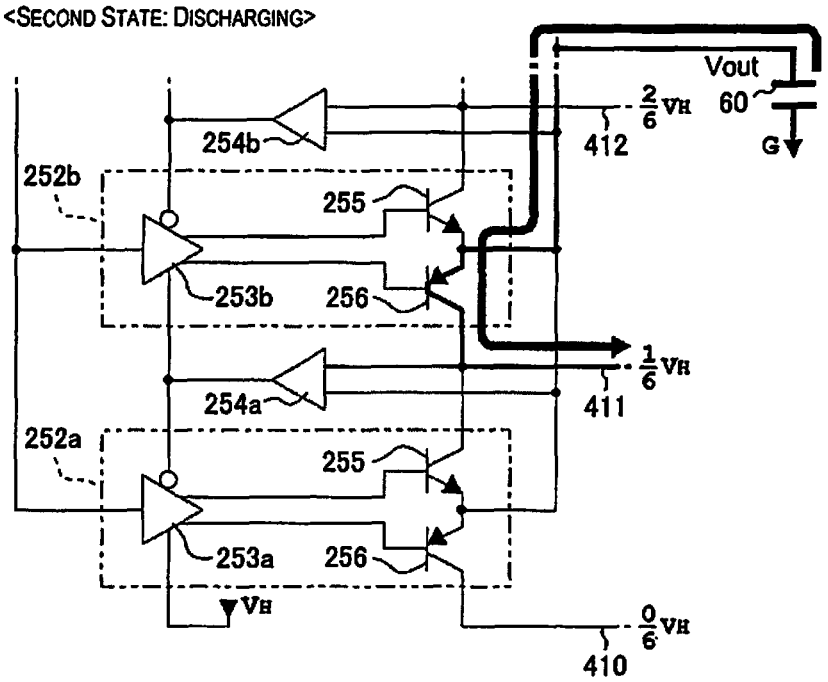
FIG. 30 is a diagram for explaining the flow of current (charge) in the path selection section.

FIG. 30 is a diagram illustrating an operation when the piezoelectric element 60 is discharging when in the second state. The level shifter 253*b* is in the enable state in the second state. When the control signal Vin is lower than the voltage Vout in this state, current flows according to the voltage between the base and the emitter in the transistor 256 of the unit circuit 252*b*. On the other hand, the transistor 255 of the unit circuit 252*b* is turned off When discharging in the second state, charge is discharged from the piezoelectric element 60 due to current flowing in a path of the piezoelectric element 60→the transistor 256 (of the unit circuit 252*b*)→the power source wiring 411 as shown by the arrow in FIG. 30. That is, in a case where the piezoelectric element 60 is being charged with charge in the first state and in a case where current is being discharged from the piezoelectric element 60 in the second state, one end of the piezoelectric element 60 is electrically connected with regard to the power source circuit 260 via the power source wiring 411. In addition, the power source wiring 411 supplies current (charge) when charging in the first state and recovers current (charge) when discharging in the second state. The charge which is recovered is redistributed to and reused by the power source circuit 260 as will be described later. Discharging of the piezoelectric element 60 stops due to the transistor 256 of the unit circuit 252*b* being turned off when the voltage Vout gets closer to the control signal Vin and eventually matches with the control signal Vin.

On the other hand, since, in a case where the control signal Vin is lowered to be less than the voltage $1V_H/6$, the voltage Vout tracks the control signal Vin and reaches the voltage $1V_H/6$, there is a shift from the second state to the first state.

Figure 31:
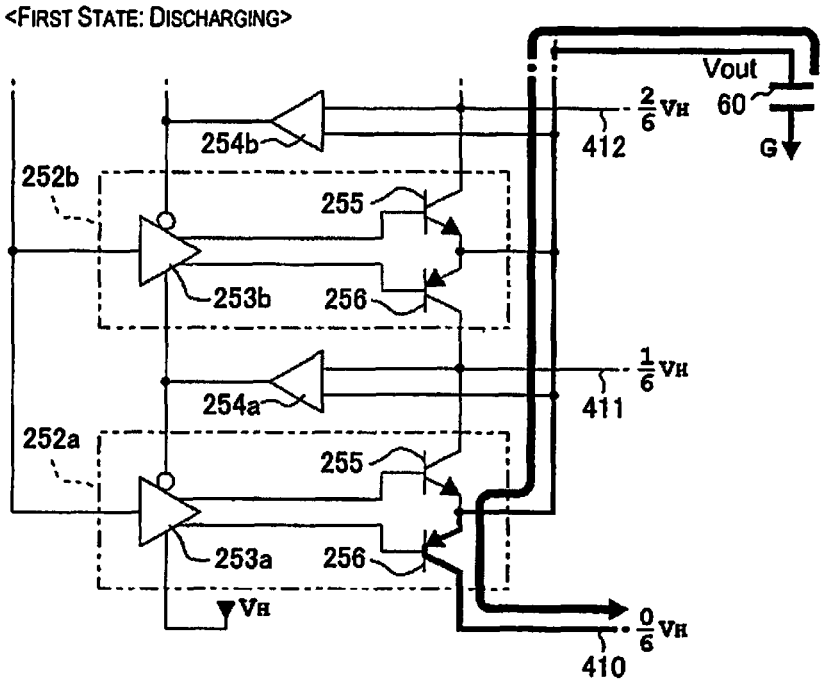
FIG. 31 is a diagram for explaining the flow of current (charge) in the path selection section.

FIG. 31 is a diagram illustrating an operation when the piezoelectric element 60 is discharging when in the first state. The level shifter 253*a* is in the enable state in the first state. When the control signal Vin is lower than the voltage Vout in this state, current flows according to the voltage between the base and the emitter in the transistor 256 of the unit circuit 252*a*. Here, the transistor 255 of the unit circuit 252*a* is turned off.

When discharging in the first state, charge is discharged from the piezoelectric element 60 due to current flowing in a path of the piezoelectric element 60→the transistor 256 (of the unit circuit 252*a*)→the power source wiring 410 as shown by the arrow in FIG. 31. In addition, the power source wiring 410 recovers current (charge) when discharging in the first state. The charge which is recovered is redistributed to and reused by the power source circuit 260 as will be described later.

Note that, here, charging and discharging are described separately with the unit circuits 252*a* and 252*b* as examples, and the unit circuits 252*c* to 252*f* carry out substantially the same operations except for the point that the transistors 255 and 256 which control the current are different. In addition, the paths from one end of the piezoelectric element 60 to the connection point between the emitter terminals in the transistors 255 and 256 are the same in the discharging path and the charging path for each of the states.

When the capacity of a capacitive load such as the piezoelectric element 60 is set as C and the voltage amplification is set as E, energy PW which is accumulated in the capacitive load is typically expressed as $PW=(C\cdot E^2)/2$. The work of the piezoelectric element 60 is to change shape depending on the energy PW and the amount of work for discharging ink is equal to or less than 1% with regard to the energy PW. Accordingly, it is possible for the piezoelectric element 60 to be seen as simply as capacity. When the capacity C is charged using a certain power source, energy which is equal to $(C\cdot E^2)/2$ is consumed by the charging path. The same amount of energy is also consumed by the discharging path when discharging.

In the present embodiment, when the piezoelectric element 60 is charged from the voltage $0V_H/6$ to the voltage $V_H$, the power source wiring which supplies current to the piezoelectric element 60 in the path selection section 250 switches in order over six stages of the power source wiring 411 in the first state, the power source wiring 412 in the second state, the power source wiring 413 in the third state, the power source wiring 414 in the fourth state, the power source wiring 415 in the fifth state, and the power source wiring 416 in the sixth state. The reverse of this is that when the piezoelectric element 60 discharges from the voltage $V_H$ to the voltage $0V_H/6$, the power source wiring which recovers current from the piezoelectric element 60 in the path selection section 250 switches in order over six stages in the opposite order to the order when charging.

Figure 34:
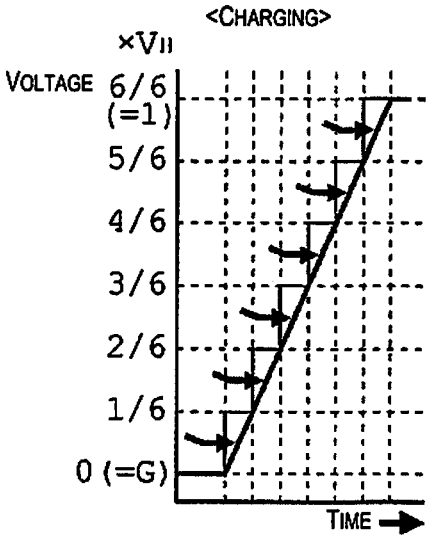
FIG. 34 is a diagram for explaining loss when charging and discharging of the path selection section.
Figure 35:
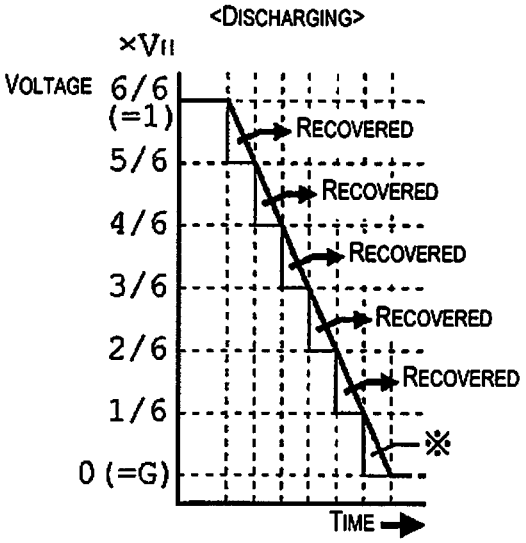
FIG. 35 is a diagram for explaining loss when charging and discharging of the path selection section.
Figure 41:
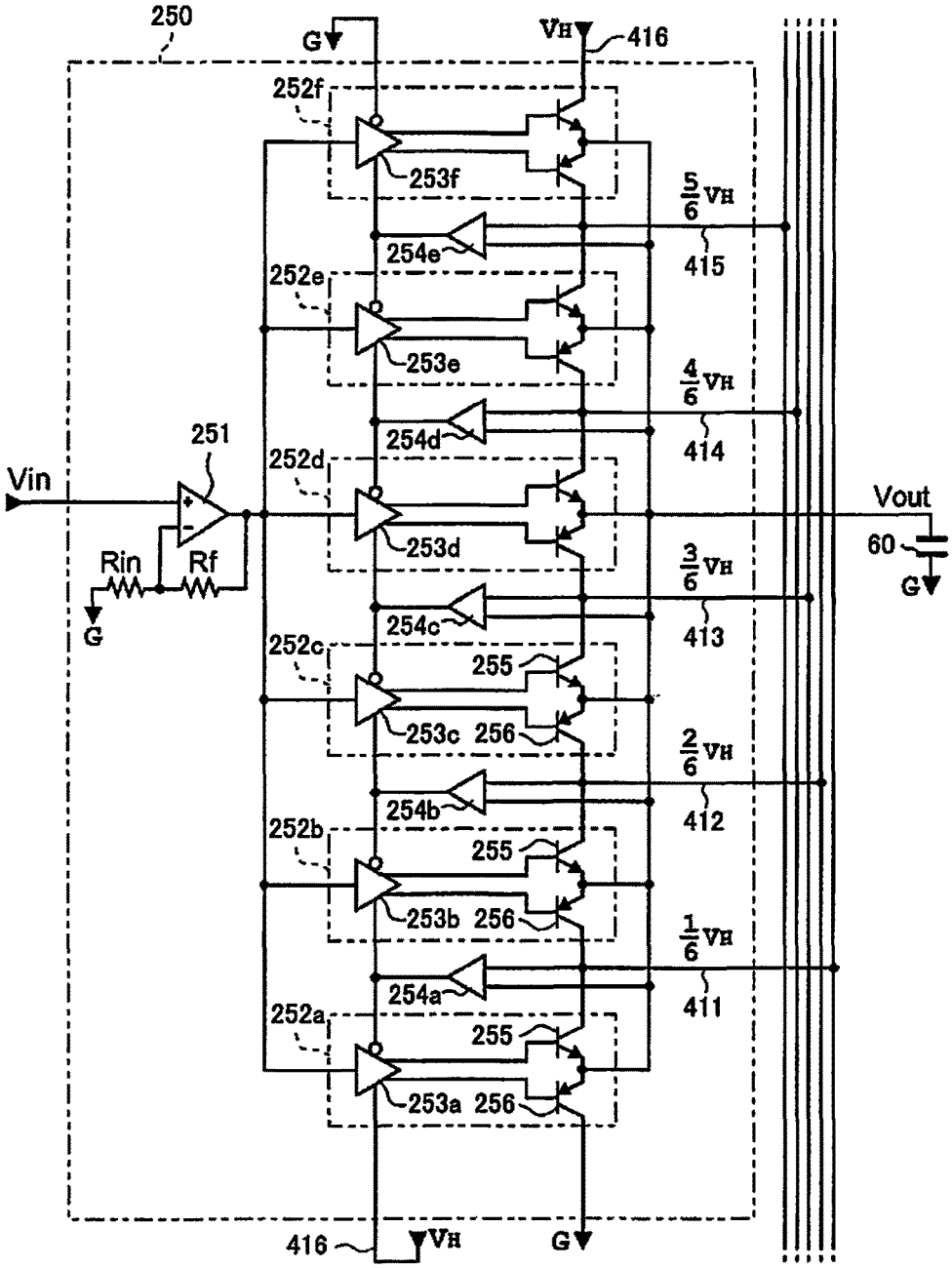
FIG. 41 is a diagram illustrating a configuration of a path selection section as in a comparative example.

Here, there is an assumption of a configuration as a comparative example where the power source circuit 260 does not generate the voltage $0V_H/6$ and the emitter terminal of the transistor 256 of the unit circuit 252*a* is connected to the ground as shown in FIG. 41. In this comparative example, loss when charging is equivalent to the area of the region where there is hatching in FIG. 34. In detail, loss when charging in the piezoelectric element 60 is 6/36(=16.7%) compared to linear amplification of charging from a voltage of zero directly to the voltage $V_H$. In the comparative example, loss when discharging is limited to 6/36(=16.7%) which is the same as above compared to a linear method of discharging from the voltage $V_H$ directly to a voltage of zero as shown by the portion which is equivalent to the area of the region where there is hatching in FIG. 35. However, it is possible to redistribute and reuse the charge, which is included as loss when discharging except for the charge (the region which is marked with ※) when discharging from the voltage $0V_H/6$ to a voltage of zero, by the charge being recovered by the power source circuit 260. In order words, it is not possible for the power source circuit 260 to recover the charge when discharging from the voltage $0V_H/6$ to a voltage of zero, that is, the charge which is discharged from the piezoelectric element 60 using the unit circuit 252*a* which is associated with the lowest voltages.

Figure 32:
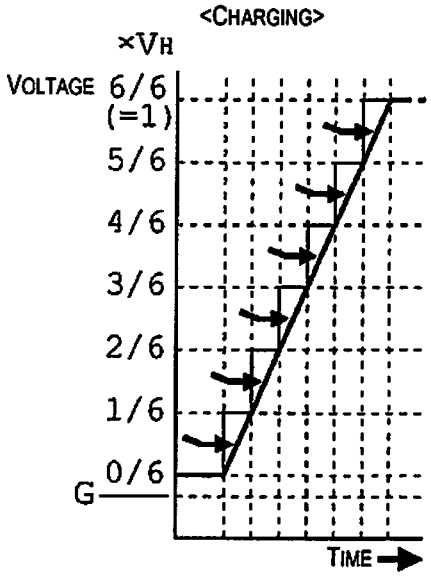
FIG. 32 is a diagram for explaining loss when charging and discharging of the path selection section.
Figure 33:
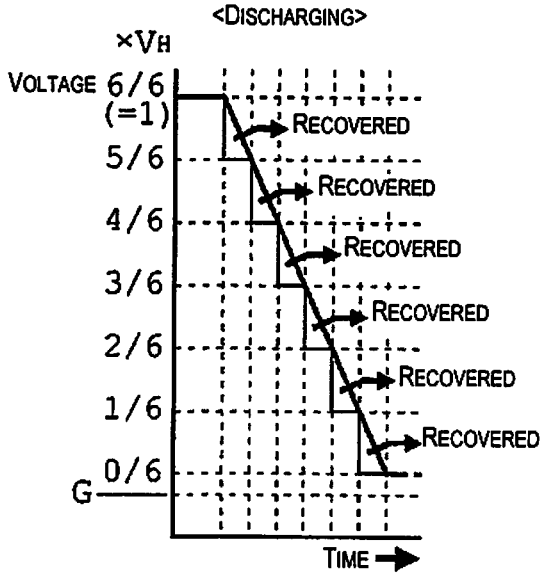
FIG. 33 is a diagram for explaining loss when charging and discharging of the path selection section.

In contrast to this, loss when charging as shown in FIG. 32 and loss when discharging as shown in FIG. 33 are substantially the same in the present embodiment. However, since it is possible for the power source circuit 260 to recover the charge, which is discharged from the piezoelectric element 60 using the unit circuit 252*a*, via the power source wiring 410, it is possible to achieve further energy savings with regard to the comparative example.

Here, FIG. 32 to FIG. 35 are merely conceptual diagrams for explaining the driving operations of the piezoelectric elements 60 using the path selection section 250. Since the piezoelectric elements 60 are driven in practice by the trapezoidal waveforms Adp1, Adp2, Bdp1, and Bdp2 in the control signals CtrlA and CtrlB being selected, the piezoelectric elements 60 are not normally driven with an amplitude from a voltage of zero to the voltage $V_H$.

In the path selection section 250 of the liquid discharge apparatus 1 as in the present embodiment, there are no problems such as the quality of the waveforms being poor and EMI measures being necessary due to the transistors 255 and 256 which are equivalent to the output stage not carrying out switching such as class D amplification or not using the inductor L. In addition, precise control is possible with regard to the piezoelectric element 60 due to the operation in the present embodiment where the voltage Vout tracks the voltage of the control signal Vin.

4-3. Configuration of Power Source Circuit

Figure 36:
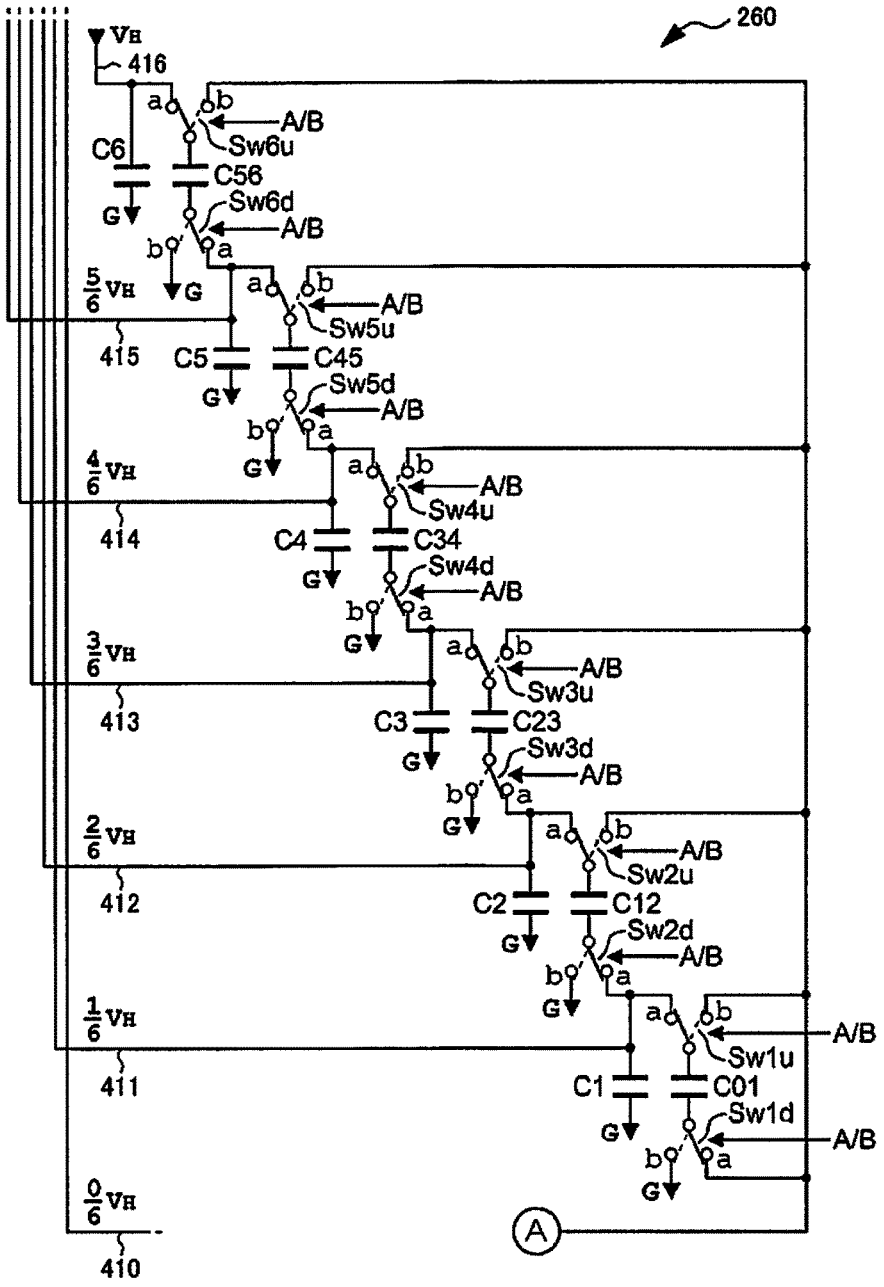
FIG. 36 is a diagram illustrating one example of the configuration of a power source circuit in the drive circuit.
Figure 37:
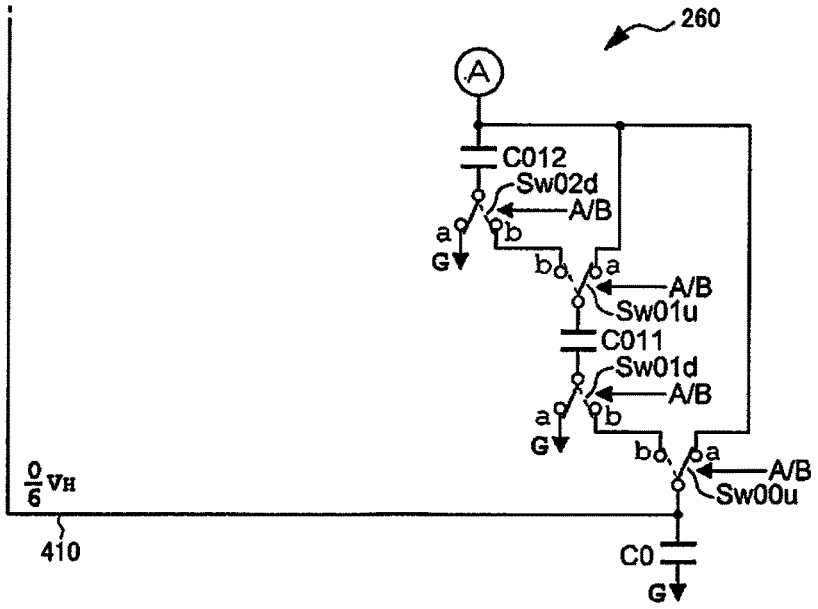
FIG. 37 is a diagram illustrating one example of the configuration of the power source circuit in the drive circuit.

FIG. 36 and FIG. 37 are diagrams illustrating one example of the configuration of the power source circuit 260. As shown in FIG. 36 and FIG. 37, the power source circuit 260 is configured to include switches Sw6*u*, Sw6*d*, Sw5*u*, Sw5*d*, Sw4*u*, Sw4*d*, Sw3*u*, Sw3*d*, Sw2*u*, Sw2*d*, Sw1*u*, Sw1*d*, Sw02*d*, Sw01*u*, Sw01*d*, and Sw00*u*, and capacitive elements C6, C56, C5, C45, C4, C34, C3, C23, C2, C12, C1, C01, C012, C011, and C0.

Out of this configuration, the switches are all single-pole double-throw switches, and common terminals are connected to either of terminals a and b in accordance with control signals A/B. When the control signals A/B are described in a simple manner, the control signals A/B are pulse signals with a duty ratio of, for example, approximately 50% and the frequency of the control signals A/B is set at, for example, 20 times with regard to the frequency of the control signals CtrlA and CtrlB. In this manner, the control signals A/B may be generated using an internal oscillator (which is omitted from the diagrams) in the power source circuit 260 or may be supplied from the control unit 10 via the flexible cable 190.

The capacitive elements C56, C45, C34, C23, C12, and C01 are for moving charge and the capacitive elements C1, C2, C3, C4, and C5 are for backup (holding). The capacitive elements C012, C011, and C0 are for both moving charge and backup and the capacitive element C6 is for supplying the power source voltage $V_H$.

The switches described above are configured in practice by combining transistors in a semiconductor integrated circuit, and the capacitive elements are installed externally with regard to the semiconductor integrated circuit. Here, it is desirable for the semiconductor integrated circuit to be configured so as to form a plurality of the path selection sections 250 described above.

Here, in the power source circuit 260, the power source wiring 416 which supplies the voltage $V_H$ is connected to one end of the capacitive element C6 and the terminal a of the switch Sw6*u*. The common terminal of the switch Sw6*u* is connected to one end of the capacitive element C56 and the other end of the capacitive element C56 is connected to the common terminal of the switch Sw6*d*. The terminal a of the switch Sw6*d* is connected to one end of the capacitive element C5 and the terminal a of the switch Sw5*u*. The common terminal of the switch Sw5*u* is connected to one end of the capacitive element C45 and the other end of the capacitive element C45 is connected to the common terminal of the switch Sw5*d*. The terminal a of the switch Sw5*d* is connected to one end of the capacitive element C4 and the terminal a of the switch Sw4*u*. The common terminal of the switch Sw4*u* is connected to one end of the capacitive element C34 and the other end of the capacitive element C34 is connected to the common terminal of the switch Sw4*d*. The terminal a of the switch Sw4*d* is connected to one end of the capacitive element C3 and the terminal a of the switch Sw3*u*. The common terminal of the switch Sw3*u* is connected to one end of the capacitive element C23 and the other end of the capacitive element C23 is connected to the common terminal of the switch Sw3*d*. The terminal a of the switch Sw3*d* is connected to one end of the capacitive element C2 and the terminal a of the switch Sw2*u*. The common terminal of the switch Sw2*u* is connected to one end of the capacitive element C12 and the other end of the capacitive element C12 is connected to the common terminal of the switch Sw2*d*. The terminal a of the switch Sw2*d* is connected to one end of the capacitive element C1 and the terminal a of the switch Sw1*u*. The common terminal of the switch Sw1*u* is connected to one end of the capacitive element C01 and the other end of the capacitive element C01 is connected to the common terminal of the switch Sw1*d*. The terminal a of the switch Sw1*d* is connected to each of the terminals b in the switches Sw6*u*, Sw5*u*, Sw4*u*, Sw3*u*, Sw2*u*, and Sw1*u*.

The terminal a of the switch Sw1*d* is also connected to one end of the capacitive element C012 and each of the terminals a in the switches Sw01*u* and Sw00*u* as shown in FIG. 37. The other end of the capacitive element C012 is connected to the common terminal of the switch Sw02*d* and the terminal b of the switch Sw02*d* is connected with the terminal b of the switch Sw01*u*. The common terminal of the switch Sw01*u* is connected to one end of the capacitive elements C011 and the other end of the capacitive element C011 is connected to the common terminal of the switch Sw01*d*. The terminal b of the switch Sw01*d* is connected to the terminal b of the switch Sw00*u*. The common terminal of the switch Sw00*u* is connected to one end of the capacitive element C0.

In addition, one end of the capacitive element C5 is connected to the power source wiring 415. In the same manner, one ends of the capacitive elements C4, C3, C2, C1, and C0 are respectively connected to the power source wirings 414, 413, 412, 411, and 410.

Here, each of the other ends in the capacitive elements C6, C5, C4, C3, C2, C1, and C0, each of the terminals b in the switches Sw6*d*, Sw5*d*, Sw4*d*, Sw3*d*, Sw2*d*, and Sw1*d*, and each of the terminals a in the switches Sw02*d* and Sw01*d* are connected in common to the ground.

Figure 38:
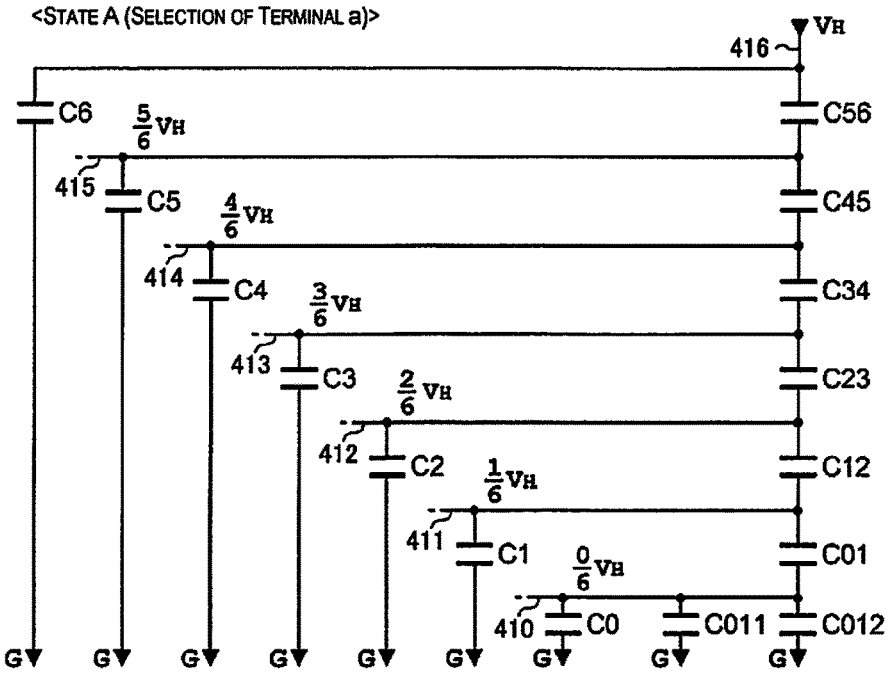
FIG. 38 is a diagram for explaining the operations of the power source circuit.
Figure 39:
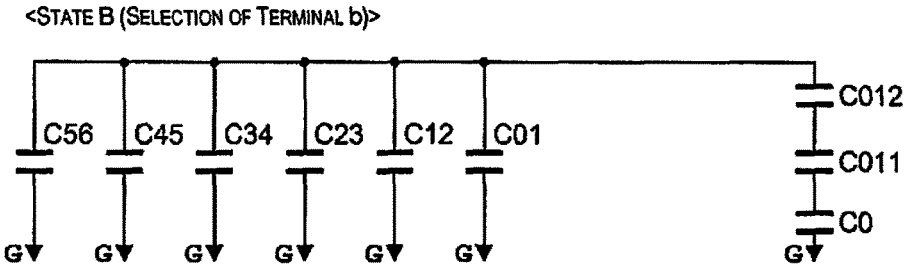
FIG. 39 is a diagram for explaining the operations of the power source circuit.

FIG. 38 and FIG. 39 are diagrams illustrating the connection state of the switches of the power source circuit 260. Each of the switches take on two states of a state (state A) where the common terminal is connected to the terminal a depending on the control signal A/B and a state (state B) where the common terminal is connected to the terminal b depending on the control signal A/B. FIG. 38 simply shows connection in the state A in the power source circuit 260 using equivalent circuits and FIG. 39 simply shows connection in the state B in the power source circuit 260 using equivalent circuits.

In the state A, the capacitive elements C012, C011, and C0 are connected to each other in parallel. When this connection in parallel is considered as one combined parallel capacity, the capacitive elements C56, C45, C34, C23, C12, and C01 and the parallel capacity are connected in series between the power source voltages from the voltage $V_H$ to the power source voltage G (the ground potential) in the state A.

In the state B, the capacitive elements C012, C011, and C0 are connected to each other in series. When this connection in series is considered as one combined series capacity, the capacitive elements C56, C45, C34, C23, C12, and C01 and the series capacity are connected in parallel in a state separate from the voltage $V_H$ in the state B. For this reason, the holding voltages of the capacitive elements C012, C011, and C0 and the combined capacity are equalized.

When the state A and the state B are alternately repeated, the voltage which is equalized when in the state B accumulates in the state A and is transferred to each of the capacitive elements C5, C4, C3, C2, C1, and C0. Then, the voltage which is transferred is supplied to the path selection section 250 via the power source wirings 415 to 410. Here, the capacitive elements C5, C4, C3, C2, C1, and C0 continue to hold the voltage which is transferred in the state A even when separated from the capacitive elements C45, C34, C23, C12, and C01 in the state B.

Here, when the capacity of the capacitive elements C56, C45, C34, C23, C12, and C01 and the capacitive elements C012, C011, and C0 are equal to each other and the voltage held by the capacitive elements C012, C011, and C0 which configure the series capacity in the state B is set at "1", the voltage held by each of the capacitive elements C56, C45, C34, C23, C12, and C01 is "3". For this reason, the power source voltage $V_H$ is "19", the voltage at one end of the capacitive element C5 (one end of the capacitive element C45) is "16", the voltage at one end of the capacitive element C4 (one end of the capacitive element C34) is "13", the voltage at one end of the capacitive element C3 (one end of the capacitive element C23) is "10", the voltage at one end of the capacitive element C2 (one end of the capacitive element C12) is "7", the voltage at one end of the capacitive element C1 (one end of the capacitive element C45) is "4", and the voltage at one end of the capacitive element C0 (one end of the capacitive element C45) is "1".

Accordingly, the voltage $5V_H/6$ of the power source voltage 415 is $16/19$ times the voltage $V_H$ as described above, and in the same manner, the voltage $4V_H/6$ is $13/19$ times the voltage $V_H$, the voltage $3V_H/6$ is $10/19$ times the voltage $V_H$, the voltage $2V_H/6$ is $7/19$ times the voltage $V_H$, the voltage $1V_H/6$ is $4/19$ times the voltage $V_H$, and the voltage $0V_H/6$ is $1/19$ times the voltage $V_H$.

Here, when the piezoelectric element 60 is charged and discharged using the path selection section 250, variation appears in the voltages held by the capacitive elements C0 to C5. In the capacitive elements where the held voltage falls due to charging of the piezoelectric element 60, there is compensation of the charge from the power source using the series connection in the state A and equalization through redistribution using the parallel connection in the state B. On the other hand, when the piezoelectric element 60 discharges using the path selection section 250, increases appear in the held voltages, but there is output of charge using the series connection in the state A and equalization through redistribution using the parallel connection in the state B. For this reason, when viewing over the entirety of the power source circuit 260, there is balance due to holding of the voltages $0V_H/6$, $1V_H/6$, $2V_H/6$, $3V_H/6$, $4V_H/6$, and $5V_H/6$.

Here, when the charge which is output is not able to be absorbed by the capacitive elements C56, C45, C34, C23, C12, and C01 and is in surplus, the surplus charge is absorbed using the capacitive element C6, that is, is regenerated through the power source system. In this manner, the power source circuit 260 functions as a regeneration circuit using the capacitive element C6, and the drive circuit 240 generates the driving signals by utilizing the regeneration circuit. Here, the drive circuit 240 may generate the driving signals by utilizing a regeneration circuit using a secondary battery instead of the regeneration circuit using the capacitive element C6.

The charge which is regenerated through the power source system is used in driving of the load if there is another load other than the piezoelectric elements 60. Since the charge is absorbed by the other capacitive elements which include the capacitive element C6 if there are no other loads, the power source voltage $V_H$ rises and ripples are generated. Here, it is possible to substantially avoid the capacity of a coupling capacitor from increasing by including the capacitive element C6.

The voltage waveforms of the control signal Vin is a set with a rising voltage for pulling in ink into the cavities 631 and a falling voltage for discharging ink from the nozzles 651, and this set is repeated in the printing operation. For this reason, the charge which is recovered through discharging of the piezoelectric element 60 is utilized in the power source circuit 260 for charging from the next time onward.

Accordingly, when viewing over the entirety of the liquid discharge apparatus 1 in the present embodiment, it is possible to suppress the power which is consumed to be low by recovering and reusing the charge which is discharged from the piezoelectric elements 60 and by charging and discharging in stages in the path selection section 250 (refer to FIG. 32 and FIG. 33).

In addition, there are the following advantages in the present embodiment in addition to being able to achieve lower power consumption. When described in detail, the amplitude of the control signal Vin (COM-A and COM-B) is set according to the individual performance of the piezoelectric elements 60, the movement velocity of the carriage 24, the properties of the printing medium P, and the like. For example, the control signal Vin is set to a comparatively low amplitude as shown by a waveform WA in FIG. 40 when driving the piezoelectric element 60 where the performance is high (efficiency is high). In addition, for example, the control signal Vin is set to a large amplitude as shown by a waveform WB when driving the piezoelectric element 60 where the performance is low (efficiency is low).

The amplitude of the control signal Vin differs in this manner according to the various types of settings, but losses increases when the voltage $V_H$ is fixed in a high state to match with the waveform WA where the amplitude is high. In particular, waste is high when driving with the waveform WA where the amplitude is low. In detail, when the voltage $V_H$ is fixed in a state of using a range of, for example, six voltages when driving with the waveform WA where the amplitude is high in the path selection sections 250, only the range of five voltages is used when driving with the waveform WB where the amplitude is low, and losses increase when charging and discharging due to the lower number of voltages in the range (number of voltage divisions) which are used by the path selection sections 250.

Figure 40:
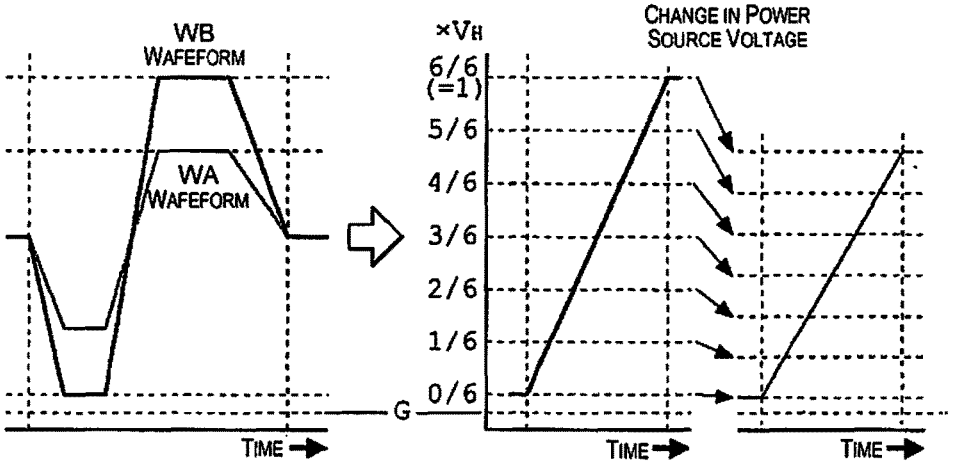
FIG. 40 is a diagram illustrating the changes in voltage in the power source circuit.

In the present embodiment, if the power source voltage $V_H$ is changed to match with the amplitude of the control signal Vin (COM-A and COM-B), the voltage which is generated using the power source circuit 260 as shown in FIG. 40 is changed as per the ratio with regard to the voltage $V_H$. For this reason, even if the control signal Vin (COM-A and COM-B) changes, losses when charging and discharging does not increase due to the number of voltage divisions being the same.

Here, it is obvious that the liquid discharge apparatus 1 and the head unit 2 as in the fourth embodiment achieve the same effects as the first embodiment, the second embodiment, and the third embodiment.

5. Modified Examples

Ink is supplied from the ink cartridge 22 which is mounted in the carriage 24 to the head 20 in each of the embodiments described above, but there may be a configuration where ink is supplied from an ink tank which is fixed to the main body of the liquid discharge apparatus 1 to the head 20 via an ink tube.

In addition, the control unit 10 and the head unit 2 are connected using the flexible cable 190 in each of the embodiments described above, but the various types of signals from the control unit 10 to the head unit 2 may be transmitted using wiring or may be transmitted wirelessly. That is, the control unit 10 and the head unit 2 need not be connected using the flexible cable 190.

In addition, the liquid discharge apparatus 1 as in each of the embodiments described above may be a large format printer. A large format printer is a printer where the maximum size of the medium which is able to be printed on is A2 size of paper sheets (420 mm×594 mm) or larger. As a result of there being a large number of the nozzles 651 in large format printers in order to realize high-speed printing and high-precision printing, high-precision scanning using the carriage 24 is difficult due to the extent by which the size and weight of the head unit 2 increase. According to the liquid discharge apparatus 1 as in each of the embodiments described above, the control unit 10 (the control section 100) is able to carry out high-precision scanning using the carriage 24 and it is possible to realize high printing quality due to the position of the center of gravity of the head unit 2 being relatively close to the carriage guide shaft 32.

In addition, each of the embodiments described above are described with the piezoelectric elements which discharge ink as an example of the targets for driving by the drive circuits, but the targets for driving are not limited to the piezoelectric elements and the targets for driving may be, for example, capacitive loads such as an ultrasonic motor, a touch panel, a flat speaker, and a display such as a liquid crystal display. That is, it is sufficient if the drive circuits drive a capacitive load.

Embodiments and modified examples are described above, but the present invention is not limited to these embodiments or modified examples, and it is possible to realize various aspects within a range which does not depart from the gist of the present invention. For example, it is possible to appropriately combine each of the embodiments and each of modified examples described above.

The present invention includes configurations which are substantially the same as the configurations which are described in the embodiments (for example, configurations where the functions, the methods, and the results are the same and configurations where the objectives and the results are the same). In addition, the present invention includes configurations where a portion, which is not essential to the configurations which are described in the embodiments, is replaced. In addition, the present invention includes configurations which deliver the same operational effects as the configurations which are described in the embodiments and configurations where it is possible for the same objectives as the configurations which are described in the embodiments to be achieved. In addition, the present invention includes configurations where common techniques are added to the configurations which are described in the embodiments.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A liquid discharge apparatus comprising:

a head provided with discharge sections including nozzles which discharge a liquid;

a drive circuit configured to generate driving signals for driving the discharge sections and discharging the liquid;

a carriage mounted with the head and the drive circuit; and a carriage guide shaft attached to the carriage, the carriage guide shaft being configured and arranged to support the carriage, the discharge sections being disposed below the carriage, a shortest distance between the carriage guide shaft and the drive circuit being shorter than a shortest distance between the carriage guide shaft and the discharge section which is closest to the carriage guide shaft, and the drive circuit being further configured to generate the driving signals using a class D amplifier.

2. The liquid discharge apparatus according to claim 1, wherein the drive circuit is further configured to generate the driving signals using a regeneration circuit using a capacitor or a secondary battery.

3. The liquid discharge apparatus according to claim 1, wherein the head is provided with a discharge section row which is formed from a plurality of the discharge sections and a supply opening which supplies the liquid to the plurality of discharge sections included in the discharge section row, and a distance between the supply opening and a discharge section which is at a center of the discharge section row is shorter than distances between the supply opening and each of the two discharge sections which are at both ends of the discharge section row.

4. The liquid discharge apparatus according to claim 3, wherein a distance between the supply opening and the discharge section which is at one end of the discharge section row and a distance between the supply opening and the discharge section which is at the other end of the discharge section row are substantially the same.

5. A head unit comprising:

a head provided with discharge sections including nozzles which discharge a liquid;

a drive circuit configured to generate driving signals for driving the discharge sections and discharging the liquid;

a carriage mounted with the head and the drive circuit; and a connection section configured and arranged such that a carriage guide shaft is inserted thereinto to connect with the carriage guide shaft, the carriage guide shaft supporting the carriage, the discharge sections being disposed below the carriage, a shortest distance between the connection section and the drive circuit being shorter than a shortest distance between the connection section and the discharge section which is closest to the connection section, and the drive circuit being further configured to generate the driving signals using a class D amplifier.

* * * * *